US006026262A

United States Patent [19]

Kinoshita et al.

[11] Patent Number: 6,026,262

[45] Date of Patent: Feb. 15, 2000

[54] IMAGE FORMING APPARATUS EMPLOYING ELECTROPHOTOGRAPHIC PHOTOCONDUCTOR

[75] Inventors: Takehiko Kinoshita; Yasuo Suzuki, both of Shizuoka, Japan

[73] Assignee: Ricoh Company, Ltd., Tokyo, Japan

[21] Appl. No.: 09/289,941

[22] Filed: Apr. 13, 1999

[30] Foreign Application Priority Data

Apr. 14, 1998 [JP] Japan ..... 10-120072
Apr. 13, 1999 [JP] Japan ..... 11-105811

[51] Int. Cl.[7] ..... G03G 15/08

[52] U.S. Cl. ..... 399/252; 430/56; 430/58.05; 430/65; 430/127; 430/132; 430/133; 430/134

[58] Field of Search ..... 430/56, 58.05, 430/165, 127, 132, 133, 134; 399/252

[56] References Cited

U.S. PATENT DOCUMENTS

| | | | |
|---|---|---|---|
| 4,504,564 | 3/1985 | Pai et al. | 430/127 |
| 5,561,016 | 10/1996 | Suzuki et al. | 430/96 |
| 5,578,405 | 11/1996 | Ikegami et al. | 430/76 |
| 5,612,158 | 3/1997 | Iguchi et al. | 430/63 |
| 5,633,046 | 5/1997 | Petropoulos et al. | 427/430.1 |
| 5,645,117 | 7/1997 | Nealey et al. | 430/56 |
| 5,677,096 | 10/1997 | Suzuki | 430/60 |
| 5,776,650 | 7/1998 | Hashimoto et al. | 430/134 |
| 5,863,685 | 1/1999 | DeFeo et al. | 430/132 |
| 5,871,875 | 2/1999 | Chambers et al. | 430/134 |

FOREIGN PATENT DOCUMENTS

| | | |
|---|---|---|
| 0 408 380 | 1/1991 | European Pat. Off. . |
| 0 411 532 | 2/1991 | European Pat. Off. . |
| 0 660 192 | 6/1995 | European Pat. Off. . |

*Primary Examiner*—Roland Martin
*Attorney, Agent, or Firm*—Oblon, Spivak, McClelland, Maier & Neustadt, P.C.

[57] ABSTRACT

An image forming apparatus has a charging unit, an image exposure unit, a reversal development unit, an image transfer unit, and an electrophotographic photoconductor including an electroconductive support and a photoconductive layer formed thereon, the photoconductive layer being provided by coating and drying a photoconductive layer formation liquid containing a solvent, with a change in the content of the solvent in the photoconductive layer dried being 10% or less 24 hours after the drying thereof.

11 Claims, 5 Drawing Sheets

IMAGE FORMING APPARATUS EMPLOYING ELECTROPHOTOGRAPHIC PHOTOCONDUCTOR

BACKGROUND OF THE INVENTION

1. Field of the Invention

The present invention relates to an image forming apparatus, and more particularly to an image forming apparatus comprising at least a charging unit, an image exposure unit, a reversal development unit, an image transfer unit, and an electrophotographic photoconductor.

2. Discussion of Background

An image forming apparatus such as a printer, a copying machine or a facsimile machine can produce an image through a series of steps of charging, image exposure, development and image transfer. Therefore, such an image forming apparatus comprises at least a charging unit, an image exposure unit, a development unit (a reversal development unit in the present invention), an image transfer unit, and an electrophotographic photoconductor.

The above-mentioned image forming apparatus has the drawback that an abnormal image often occurs while continuously operated for an extended period of time. To eliminate such a drawback of the image forming apparatus, there are some proposals with respect to the electrophotographic photoconductor placed in the image forming apparatus. Such conventional proposals are as follows:

(1) Japanese Laid-Open Patent Application 11-15181 (MINOLTA Co., Ltd.)

An electrophotographic photoconductor is fabricated in such a manner that the surface of an aluminum or aluminum alloy support is subjected to anodizing, followed by mechanical abrasive finishing and sealing. On the support which has been subjected to sealing by dipping the support in hot water or putting the support in a moistening system, a photoconductive layer is provided.

(2) Japanese Laid-Open Patent Application 10-301314 (MINOLTA Co., Ltd.)

An electrophotographic photoconductor comprises an electroconductive support, an undercoat layer formed thereon, and a photoconductive layer formed on the undercoat layer. The aforementioned undercoat layer comprises a composition of an organoalkoxysiloxane and colloidal alumina, which composition is cured by the application of heat thereto.

(3) Japanese Laid-Open Patent Application 10-90931 (MINOLTA Co., Ltd.)

An electrophotographic photoconductor comprises an electroconductive support, an undercoat layer formed thereon, and a photoconductive layer formed on the undercoat layer. The aforementioned undercoat layer comprises a resin and heat-treated titanium oxide.

(4) Japanese Laid-Open Patent Application 5-204181 (KONICA CORPORATION)

An electrophotographic photoconductor comprises a support, and an electroconductive polyaniline layer and a photoconductive layer which are successively overlaid on the support in this order.

(5) Japanese Laid-Open Patent Application 8-44096 (Ricoh Company, Ltd.)

An electrophotographic photoconductor comprises an electroconductive support, an undercoat layer formed on the support comprising titanium oxide and a thermosetting resin, and a photoconductive layer formed on the undercoat layer. The amount ratio by volume of the thermosetting resin for use in the undercoat layer is controlled to 0.5 to 0.6 vol.

%, and the average particle size of the titanium oxide particles for use in the undercoat layer is adjusted to 0.4 $\mu$m or less. Further, there is disclosed an image forming apparatus employing the above-mentioned electrophotographic photoconductor and a reversal development unit.

(6) Japanese Laid-Open Patent Application 9-34152 (KONICA CORPORATION)

An electrophotographic photoconductor comprises an electroconductive support comprising aluminum, aluminum-manganese alloy, aluminum-magnesium alloy or aluminum-magnesium-silica alloy, an undercoat layer which is formed on the electroconductive support and comprises a compound selected from the group consisting of a metal alkoxide, an organic metal chelate, a silane coupling agent and reaction products thereof, and a photoconductive layer formed on the undercoat layer.

(7) Japanese Laid-Open Patent Application 9-292730 (KONICA CORPORATION)

An electrophotographic photoconductor for use with reversal development, comprises an electroconductive support comprising aluminum or an aluminum alloy, and an anodized layer and a photoconductive layer which are successively overlaid on the electroconductive support in this order. The distance (Sm) between the adjacent convex portions on the surface of the anodized layer is controlled to 0.3 to 250 $\mu$m, and the maximum height (Rt) of the convex portion is 0.5 to 2.5 $\mu$m. Further, the surface glossiness of the anodized layer is controlled to 60 gloss or more. (8) Japanese Laid-Open Patent Application 10-83093 (Ricoh Company, Ltd.) An electrophotographic photoconductor comprises an electroconductive support, and an undercoat layer and a photoconductive layer which are successively overlaid on the electroconductive support. The undercoat layer comprises finely-divided particles of titanium oxide, with the surface portions of the titanium oxide particles comprising at least zirconium oxide. (9) Japanese Laid-Open Patent Application 5-11473 (KONICA CORPORATION)

An electrophotographic photoconductor comprises a cylindrical electroconductive support and a photoconductive layer formed thereon. On the outer surface of the cylindrical electroconductive support, a plurality of grooves are arranged in a row around the circumference of the cylindrical support, each groove having a width of 10 $\mu$m to 1 mm and a depth of 0.1 to 5 $\mu$m and the section of each groove in the direction of the width thereof being regular. In addition, the photoconductive layer comprises as a charge generation material crystals of a mixture of a specific titanyl phthalocyanine and vanadyl phthalocyanine.

(10) Japanese Laid-Open Patent Application 6-54745 (KONICA CORPORATION)

There is disclosed reversal development method using a photoconductor which comprises a specific titanyl phthalocyanine and a specific hydrazone compound.

(11) Japanese Laid-Open Patent Application 10-221871 (KONICA CORPORATION)

There is disclosed a method of forming an image, comprising the steps of charging an electrophotographic photoconductor comprising a specific titanyl phthalocyanine to a predetermined polarity, forming a latent electrostatic image on the photoconductor using a light emitting diode (LED) as the light source, and developing the latent electrostatic image to a visible image by reversal development.

(12) Japanese Laid-Open Patent Application 7-152184 (Matsushita Electric Industrial Co., Ltd.)

An electrophotographic photoconductor comprises an electroconductive support and a layered photoconductive layer formed thereon. The photoconductive layer comprises a charge generation layer and a charge transport layer, which are successively overlaid on the electroconductive support in this order. The charge transport layer formation liquid comprises 1,1-bis(p-diethylaminophenyl)-4,4-diphenyl-1,3-butadiene as a charge transport material and tetrahydrofuran as a solvent.

In the previously mentioned proposals (1) through (9), an undercoat layer comprising a specific material is provided between the electroconductive support and the photoconductive layer, or the anodized film is deposited on the surface of the electroconductive support in order to prevent the injection of the hole into the photoconductive layer or the charge generation layer from the electroconductive support in the course of reversal development. Namely, the object is to prevent the toner deposition of the background of the photoconductor.

However, the above-mentioned various materials for use in the undercoat layer and the provision of the anodized film on the electroconductive support have a serious effect on the electrostatic properties of the photoconductor under the circumstances of high temperature and high humidity and low temperature and low humidity. For instance, the sensitivity of the photoconductor is lowered, and the potential of an image portion (a light-exposed portion) on the photoconductor is increased after the repeated operation. Thus, the image density of the obtained toner image tends to decrease.

The object of each of the previously mentioned proposals (9) to (11) is to provide a photoconductor capable of minimizing the toner deposition on the background and showing stable characteristics in the continuous operation of reversal development by employing a specific titanyl phthalocyanine alone or in combination with a specific charge transport material.

When the titanyl phthalocyanine pigment is used as a charge generation material, the sensitivity of the obtained photoconductor can be increased. This is because the titanyl phthalocyanine pigment for use in the charge generation layer can generate a large number of charge carriers and the charge carriers thus generated can be readily injected into the charge transport layer. However, since the barrier properties of such a charge generation layer itself is extremely poor, a defective image will appear promptly if the hole is injected into the charge generation layer from the electroconductive support. In addition, local defects present in the charge transport layer and the undercoat layer cannot be compensated.

According to the proposal (12), the coating liquid for the formation of the charge transport layer comprises 1,1-bis(p-diethylaminophenyl)-4,4-diphenyl-1,3-butadiene as a charge transport material and tetrahydrofuran as a solvent. The partial deterioration of charging characteristics of the photoconductor is considered to be caused by the remaining solvent component such as dichloromethane in the charge transport layer. Further, when the remaining solvent is removed from the charge transport layer by drying the charge transport layer formation liquid for a long period of time, cracks tend to occur in the obtained charge transport layer, thereby causing the noise of the produced image. Therefore, tetrahydrofuran is chosen as the solvent for the charge transport layer formation liquid in this proposal. As a matter of course, the occurrence of toner deposition on the background can be reduced in the reversal development by this proposal. However, in such a photoconductor, the toner deposition on the background is caused by the increase in residual potential and the increase in the potential of the light-exposed portion due to the deterioration of the photosensitivity during the continuous operation. Therefore, the decrease in the image density of the light-exposed portion, that is, the image portion is inevitable.

SUMMARY OF THE INVENTION

An object of the present invention is to provide an image forming apparatus comprising a charging means, an image exposure means, a reversal development means, an image transfer means, and an electrophotographic photoconductor, capable of producing high quality images in the continuous operation, with the potentials of a non-image portion and an image portion on the photoconductor being stable in any environment and the occurrence of abnormal image such as toner deposition on the background being minimized.

The above-mentioned object of the present invention can be achieved by an image forming apparatus comprising a charging unit, an image exposure unit, a reversal development unit, an image transfer unit, and an electrophotographic photoconductor comprising an electroconductive support and a photoconductive layer formed thereon, the photoconductive layer being provided by coating and drying a photoconductive layer formation liquid comprising a solvent, with a change in the content of the solvent in the photoconductive layer dried being 10% or less 24 hours after the drying thereof.

In the case where the photoconductive layer comprises a charge generation layer and a charge transport layer which are successively overlaid on the electroconductive support in this order, the change in the content of the solvent in the charge transport layer dried is 10% or less 24 hours after the drying thereof.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The electrophotographic image forming apparatus of the present invention will now be explained in detail with reference to FIG. 1 to FIG. 3, and FIG. 6 to FIG. 8.

Figure 1:
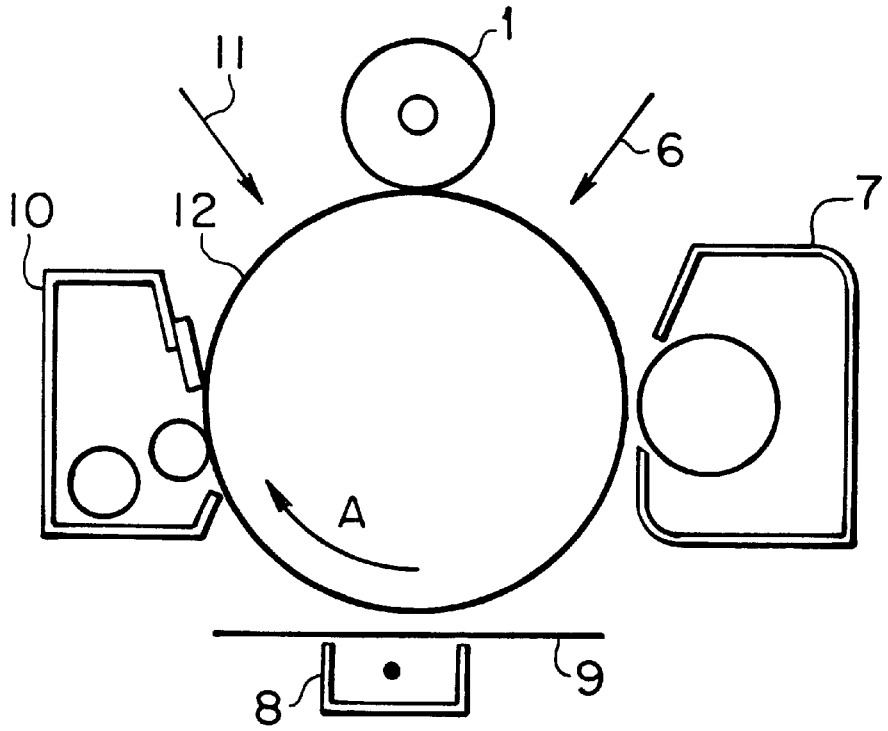
FIG. 1 is a schematic front view which shows one example of an electrophotographic image forming apparatus according to the present invention.

As shown in FIG. 1, around an electrophotographic photoconductor 12 which is rotated in a direction of arrow A, there is situated a charger 1, that is in contact with the surface of the photoconductor 12. The photoconductor 12 is positively or negatively charged to a predetermined voltage by the charger 1 at the charging step.

It is desirable that a direct voltage in the range of −2,000 V to +2,000 V be applied to the charger 1 in the course of the charging step. Alternatively, a pulsating voltage obtained by superimposing an alternating voltage on the above-mentioned direct voltage may be applied to the charger 1. In such a case, the alternating voltage with a peak-to-peak voltage of 4,000 V or less may be employed. However, when the alternating voltage is superimposed on the direct voltage, the charger 1 and the photoconductor 12 may cause vibrations, thereby making abnormal noise.

A desired voltage may be applied to the charger 1 instantaneously by one operation. Alternatively, the applied voltage may be gradually increased to a predetermined voltage in order to protect the photoconductor 12.

The charger 1 may be rotated in the same direction as that of the photoconductor 12, or not. Alternatively, the charger may come in sliding contact with the outer surface of the photoconductor 12 without rotating. In addition, the charger 1 may be provided with the function of removing residual toner deposited on the surface of the photoconductor 12. In this case, a cleaning means 10 to be described later becomes unnecessary.

The photoconductor 12 which has been charged to a predetermined polarity using the charger 1 is then exposed to a light image 6 using an image exposure means (not shown), for example, by means of slit exposure or laser beam scanning exposure. In the course of the image exposure, a non-image area is not exposed to light, while a development bias which is slightly lower than the surface potential of the charged photoconductor is applied to an image area of which potential has been decreased by light exposure, so that reversal development can be carried out. Thus, latent electrostatic images corresponding to the original images are sequentially formed on the surface of the photoconductor 12.

The thus formed latent electrostatic images are developed into visible images with a toner using a development unit 7.

The visible toner images formed on the photoconductor 12 are transferred to an image receiving member 9 using an image transfer charger 8. In this case, the image receiving member 9 is transported to a position between the photoconductor 12 and the image transfer charger 8 by a paper feeding unit (not shown), with the transportation of the image receiving member 9 being synchronized with the rotation of the photoconductor 12.

The image receiving member 9 which bears the toner image thereon is separated from the surface of the photoconductor 12 and guided to an image fixing unit (not shown in FIG. 1) where the toner image deposited on the image receiving member 9 is fixed thereto. Thus, the image-bearing image receiving member 9 is discharged from the image forming apparatus.

After the image transfer step, the residual toner is removed from the surface of the photoconductor 12 by use of the cleaning means 10, and then, the surface of the photoconductor 12 is exposed to light for quenching treatment using quenching means 11.

Such an electrophotographic image forming process can be repeatedly carried out for image formation.

A plurality of units constituting the electrophotographic image forming apparatus, such as the photoconductor 12 and the development unit 7, may be incorporated into one body that can be detached from the image forming apparatus.

Figure 2:
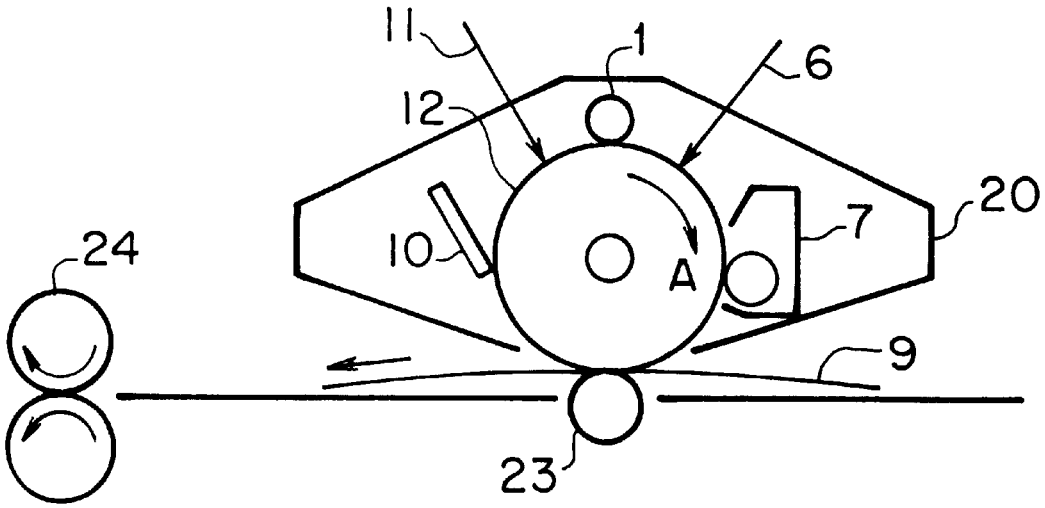
FIG. 2 is a schematic front view which shows another example of an electrophotographic image forming apparatus according to the present invention.

For instance, as shown in FIG. 2, at least the photoconductor 12, the charger 1, and the development unit 7 may be incorporated into an electrophotographic unit 20, which is detachable from the image forming apparatus. In attaching the electrophotographic unit 20 to the apparatus or detaching the same therefrom, for example, the electrophotographic unit 20 may be caused to pass through a guide rail formed in the image forming apparatus. In this case, the cleaning unit 10 may be included in the electrophotographic unit 20, or not.

Figure 3:
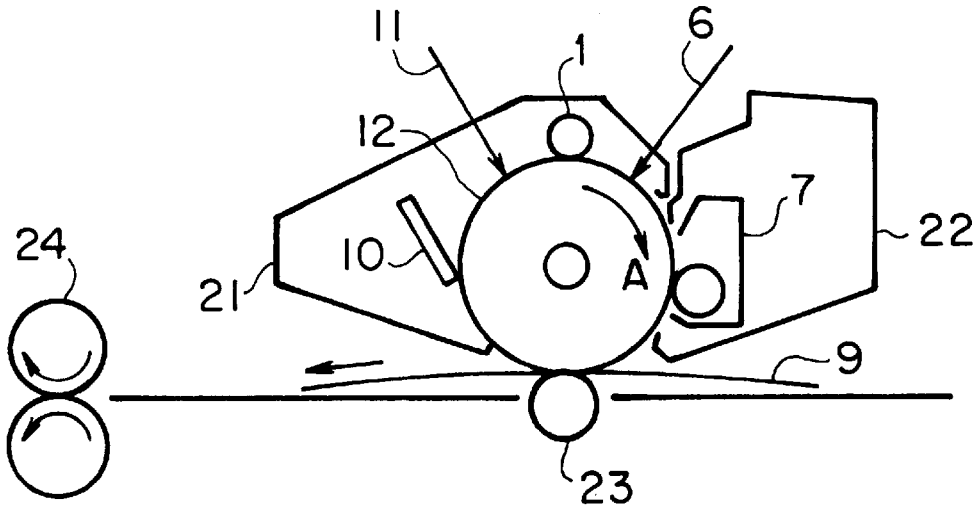
FIG. 3 is a schematic front view which shows a further example of an electrophotographic image forming apparatus according to the present invention.

Alternatively, as shown in FIG. 3, there may be separately prepared a first electrophotographic unit 21 comprising at least the photoconductor 12 and the charger 1, and a second electrophotographic unit 22 comprising at least the development unit 7. Those units 21 and 22 may be designed so as to be independently detachable from the image forming apparatus. The cleaning unit 10 may be included in the first electrophotographic unit 21, or not.

In FIG. 2 and FIG. 3, a charging roller 23 is employed as the image transfer charger. The charging roller 23 may have the same structure as that of the charger 1. It is preferable that a direct voltage of 400 to 2,000 V be applied to the image transfer charging roller 23.

Reference numeral 24 in FIG. 2 and FIG. 3 indicates an image fixing means.

The charger for use in the electrophotographic image forming apparatus of the present invention may be of a contact-type in the form of a roller (as shown in FIG. 1), brush, blade, or plate.

Figure 6:
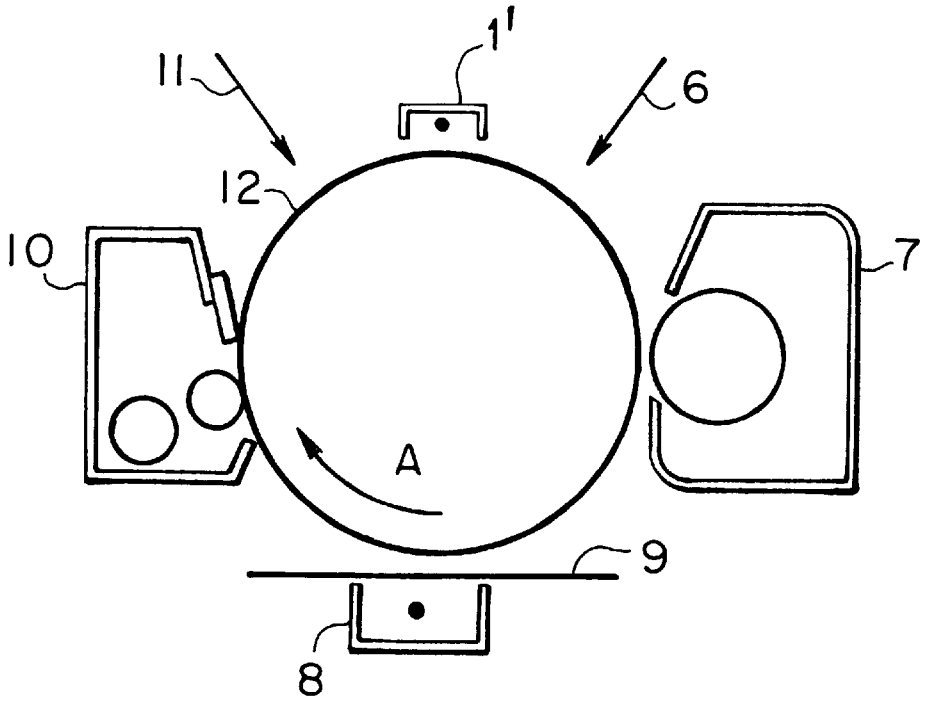
FIG. 6 is a schematic front view which shows an electrophotographic image forming apparatus obtained by modifying the apparatus of FIG. 1, in which a photoconductor is charged by non-contact method.
Figure 7:
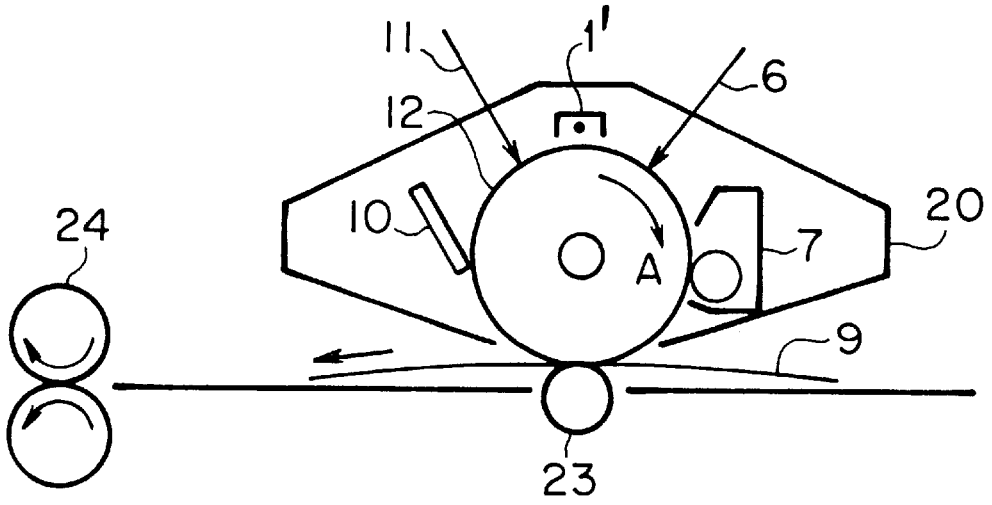
FIG. 7 is a schematic front view which shows an electrophotographic image forming apparatus obtained by modifying the apparatus of FIG. 2, in which a photoconductor is charged by non-contact method.
Figure 8:
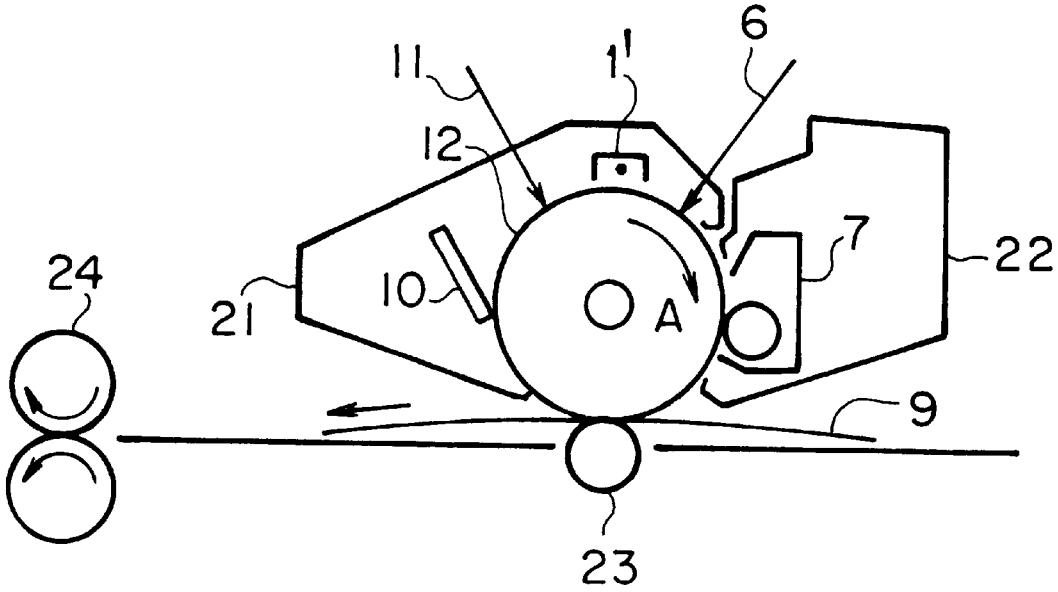
FIG. 8 is a schematic front view which shows an electrophotographic image forming apparatus obtained by modifying the apparatus of FIG. 3, in which a photoconductor is charged by non-contact method.

Further, the photoconductor 12 of the image forming apparatus according to the present invention may be charged by non-contact method. To be more specific as shown in FIG. 6, FIG. 7 and FIG. 8, there can be employed a non-contact type charger 1' such as corotron, scorotron or shield corotron.

When the charger 1 is in the form of a roller, the charging roller comprises an electroconductive core, and an elastic layer, an electroconductive layer and a high-resistant layer which are successively provided on the electroconductive core.

As the material for the electroconductive core of the charging roller, metals such as iron, copper and stainless steel, and electroconductive resins such as a carbon-dispersed resin and a metallic-powder-dispersed resin can be employed. The electroconductive core may be in the form of a rod or a plate.

The elastic layer to be provided on the electroconductive core is a layer with high elasticity. The thickness of the elastic layer is 1.5 mm or more, preferably 2 mm or more, and more preferably in the range of 3 to 13 mm..

Examples of the material for the elastic layer include chloroprene rubber, isoprene rubber, EPDM rubber, polyurethane rubber, epoxy rubber, and butyl rubber.

The electroconductive layer to be provided on the elastic layer is a layer with high electrical conductivity. It is preferable that the volume resistivity of the electroconductive layer be $10^7$ Ω.cm or less, more preferably $10^6$ Ω.cm or less, and further preferably in the range of $10^{-2}$ to $10^6$ Ω.cm.

It is desirable to decrease the thickness of the electroconductive layer so that the flexibility of the elastic layer provided under the electroconductive layer may not be lost. The thickness of the electroconductive layer is 3 mm or less, preferably 2 mm or less, and more preferably in the range of 20 μm to 1 mm.

As the electroconductive layer of the charging roller, a metal-deposited film, an electroconductive-particles-dispersed resin layer, and an electroconductive resin layer can be employed.

When the above-mentioned metal-deposited film is used as the electroconductive layer, metals such as aluminum, indium, nickel, copper and iron may be deposited on the elastic layer The electroconductive-particles-dispersed resin used for the formation of the electroconductive layer can be prepared by dispersing finely-divided particles of an electroconductive material such as carbon, aluminum, nickel or titanium oxide in a resin such as polyurethane, polyester, vinyl acetate vinyl chloride copolymer, or polymethyl methacrylate. When the electroconductive resin is employed for the formation of the electroconductive layer, there can be employed quaternary-ammonium-salt-containing polymethyl methacrylate, polyvinylaniline, polyvinylpyrrole, polydiacetylene, and polyethyleneimine.

For the preparation of the charging roller, the high-resistant layer of which resistivity is higher than that of the above-mentioned electroconductive layer is provided on the electroconductive layer. It is preferable that the volume resistivity of the high-resistant layer be in the range of $10^6$ to $10^{22}$ Ω.cm, and more preferably in the range of $10^7$ to $10^{11}$ Ω.cm.

For the formation of the high-resistant layer, there can be employed a semiconductive resin, and an electrical-insulating resin in which electroconductive particles are dispersed.

Examples of the semiconductive resin for use in the high-resistant layer are ethyl cellulose, nitrocellulose, methoxymethylated nylon, ethoxymethylated nylon, copolymerized nylon, polyvinylpyrrolidone, and casein. Those resins may be used in combination.

Alternatively, a small amount of electroconductive particles may be dispersed in an electrical-insulating resin such as polyurethane, polyester, vinyl acetate vinyl chloride copolymer, or polymethacrylic acid to control the volume resistivity of the obtained high-resistant layer. Examples of the above-mentioned electroconductive particles are particles of carbon, aluminum, indium oxide, and titanium oxide.

It is preferable that the thickness of the high-resistant layer be in the range of 1 to 500 μm, and more preferably in the range of 50 to 200 μm, from the viewpoint of charging performance.

When the contact-type charger in the form of a plate is prepared, the elastic layer and the high-resistant layer are successively provided on a metallic plate.

The contact-type charger in the form of a brush may be prepared by providing electroconductive fibers on the outer surface of the electroconductive core in a radial manner via an adhesive layer, or providing the electroconductive fibers all over a metallic plate via the adhesive layer.

The aforementioned electroconductive fibers for use in the charger show high electroconductivity, and it is preferable that the volume resistivity of the electroconductive fibers be $10^8$ Ω.cm or less, more preferably $10^6$ Ω.cm or less, and further preferably in the range of $10^{-2}$ to $10^6$ Ω.cm.

Further, in order to maintain the flexibility of the electroconductive fibers; an electroconductive fiber may be fine. For example, the diameter of an electroconductive fiber may be in the range of 1 to 100 μm, preferably in the range of 5 to 50 μm, and more preferably in the range of 8 to 30 μm. It is desirable that the length of the electroconductive fiber be in the range of 2 to 10 mm, and more preferably in the range of 3 to 8 mm.

Examples of the material for the electroconductive fibers include the previously mentioned electroconductive-particles-dispersed resin and electroconductive resin. In addition to the above, carbon fibers can be used as the electroconductive fibers for use in the present invention.

The electrophotographic photoconductor 12 for use in the present invention will now be explained in detail with reference to FIG. 4 and FIG. 5.

Figure 4:
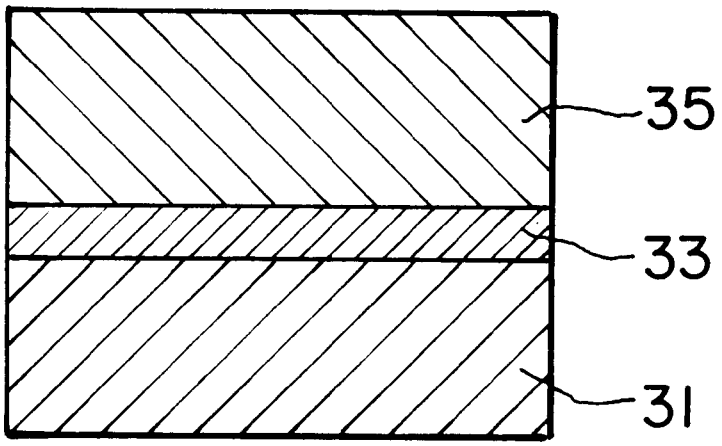
FIG. 4 is a schematic cross sectional view which shows the structure of a single-layered electrophotographic photoconductor for use in the present invention.

FIG. 4 is a cross-sectional view which shows one example of the electrophotographic photoconductor for use in the present invention. The photoconductor shown in FIG. 4 comprises an electroconductive support 31, and an undercoat layer 33 and a photoconductive layer 35 which are successively overlaid on the electroconductive support 31.

Figure 5:
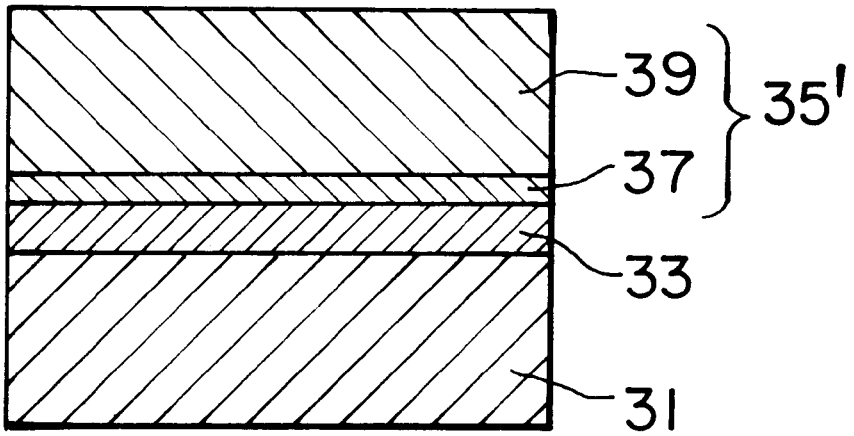
FIG. 5 is a schematic cross sectional view which shows the structure of a layered electrophotographic photoconductor for use in the present invention.

In FIG. 5, a photoconductive layer 35' comprises a charge generation layer 37 and a charge transport layer 39.

The photoconductive layer 35 of the photoconductor shown in FIG. 4 or the charge transport layer 39 of the photoconductor shown in FIG. 5 is provided by coating and drying a photoconductive layer formation liquid comprising a solvent, or a charge transport layer formation liquid comprising a solvent. According to the present invention, the change in the content of the solvent remaining in the photoconductive layer 35 or the charge transport layer 39 is 10% or less 24 hours after the drying thereof. In the present invention, the content of the solvent in the photoconductive layer 35 or the charge transport layer 39 is measured immediately after the drying operation, that is, within one hour after the drying, and 24 hours after the drying.

According to the reversal development employed in the image forming apparatus of the present invention, the surface of the photoconductor is negatively or positively charged to a predetermined potential, for instance, by use of corona charge. Thereafter, the photoconductor thus charged is exposed to a light image using the image exposure unit so as to reduce the surface potential of a light-exposed portion on the photoconductor. A toner which is previously charged to the same polarity as that of the charged photoconductor is supplied to the surface of the photoconductor, so that the toner is deposited to the above-mentioned light-exposed portion of which surface potential has been reduced. Thus, a visible toner image is formed on the surface of the photoconductor.

There is no serious problem in the conventional development method (hereinafter referred to as normal development method for convenience) by which method the charged photoconductor is exposed to a light image using the image exposure means, and a toner which carried electric charges opposite in polarity to the charged photoconductor is supplied to the surface of the photoconductor. In this case, the toner is deposited to a high-potential portion which has not been exposed to light. However, in the previously mentioned reversal development, fine black spots with a diameter of about 0.1 mm appear on the background of the image receiving member. Namely, the background portion of the copy paper is stained with toner deposition, which lowers the image quality.

It is considered that the above-mentioned problem in the reversal development is caused by local defects in the electrophotographic photoconductor employed in the image forming apparatus. When such a photoconductor is charged, the charging potential of the photoconductor is locally decreased.

When the above-mentioned defective photoconductor is subjected to the normal development, non-printed white spots appear in a solid image portion because the toner cannot be attached to the local defective portions of the photoconductor which cannot gain a predetermined surface potential. In such a case, however, it may be possible to compensate the non-printed white spots. Namely, even though the solid image portion including non-printed white spots therein is transferred to an image receiving member, the toner particles around the non-printed white spots are pressed and extended toward the non-printed spot area when the transferred toner image is fixed to the image receiving member by the application of pressure thereto.

According to the reversal development, however, the toner charged to the same polarity as that of the charged photoconductor is supplied to the photoconductor, and the toner is deposited to the portions which have been exposed to light to diminish the surface potential to form a visible image, as mentioned above. Therefore, the toner is essentially supplied to the portion of which charging potential is lowered because of the local defect of the photoconductor. In other words, the toner is locally deposited to the background portion of the photoconductor. The toner spot deposited to the background portion of the image receiving member is spread by the application of pressure thereto in the image fixing step, so that black spots with a diameter of about 0.1 mm are unfavorably formed in the background portion.

The reasons for the aforementioned local decrease of the charging potential of the photoconductor which will cause the toner deposition on the background portion are as follows:

(1) The electric charge is injected from the electroconductive support into the photoconductive layer because of the local defects in the undercoat layer which is interposed therebetween. The surface potential of the photoconductive layer is neutralized by the injection of the electric charge, thereby locally decreasing the surface potential in the course of the charging step.

(2) An oxidized gas is absorbed by the surface of the photoconductive layer, with the result that a charge transport material is decomposed. Further, by the permeation of the oxidized gas through the photoconductive layer, a charge generation material is also decomposed. Thus, electroconductive reaction products are generated and leak throughout the photoconductive layer, so that the surface potential is locally decreased.

(3) The photoconductive layer is contaminated by an electroconductive material which has been generated in the course of synthesis of a charge generation material or transfer of crystalline form of the thus synthesized charge generation material, and such an electroconductive material remains in the photoconductive layer. Thus, the surface potential of the photoconductor is locally decreased due to such an electroconductive material.

A halogenated solvent is currently employed for the formation of the photoconductive layer. However, such a solvent tends to generate a radical by the contact with water content in the air, light or heat. The thus generated radical is sequentially decomposed to produce an electroconductive ionic material. The localization of such an electroconductive ionic material in the photoconductive layer will often cause the toner deposition on the background portion.

In contrast to this, the present invention can produce the advantages, for example, by employing a specific solvent for the preparation of the photoconductive layer formation liquid. To be more specific, it is considered that there is effective interaction or structural entanglement between the molecules of the solvent and those of a binder resin or charge transport material. As a result, the charge transport material and other additives contained in the obtained photoconductive layer can be inhibited from being decomposed or undergoing the reaction even when coming in contact with various hazards such as oxidized gas, light and heat applied to the photoconductor.

The inventors of the present invention have found that the effects of the above-mentioned structural entanglement between the molecules of the solvent and those of the binder resin for use in the photoconductive layer formation liquid can be indicated by the change in the content of the solvent remaining in the obtained photoconductive layer with time. According to the present invention, the change in the content of the remaining solvent in the photoconductive layer is controlled to 10% or less when measured 24 hours after completion of the drying operation of the photoconductive layer formation liquid. As a result, the toner deposition on the background of the photoconductor can be effectively reduced in the reversal development, and stable surface potentials of an image portion and a non-image portion of the photoconductor can be maintained during the continuous operation in any environment.

In the case where the change in the content of the remaining solvent is 10% or more 24 hours after the drying of the photoconductive layer, the molecules of the solvent for use in the photoconductive layer formation liquid easily tend to undergo the reaction or cause the change by the application of various hazards thereto. Furthermore, in such a case, the compatibilities of the molecules of the solvent with those of the binder resin and the charge transport material are considered to be poor. Therefore, the solvent component is isolated to increase the gas permeability of the photoconductor and permit the oxidized gas to permeate through the photoconductive layer.

According to the present invention, it is preferable to employ at least one compound selected from the group consisting of a cyclic ether compound, an aromatic hydrocarbon compound, and derivatives of those compounds as a solvent for the preparation of the formation liquid for the photoconductive layer 35 in FIG. 4 or the charge transport layer 37 in FIG. 5. Such a compound used as the solvent remains in the photoconductive layer 35 or the charge transport layer 37 and effectively works therein.

To be more specific, the above-mentioned compounds can exhibit an anti-oxidant action in the photoconductive layer 35 or the charge transport layer 37. In addition, those compounds show high resistance to various hazards mentioned above, so that the toner deposition on the background of the photoconductor can be effectively prevented in the reversal development when at least one of the above-mentioned compounds is contained in the photoconductive layer. Further, owing to the presence of those compounds, the surface potentials of an image portion and a non-image portion of the photoconductor can become stable during the continuous operation in any environment.

Specific examples of the cyclic ether compound and derivatives thereof are as follows: 1,4-dioxane and derivatives thereof, trioxane, tetrahydrofuran and derivatives thereof, furan and derivatives thereof; furfural, 2-methylfuran, and tetrahydropyran.

Specific examples of the aromatic hydrocarbon compound and derivatives thereof are as follows: benzene, toluene, xylene and isomers thereof, ethylbenzene, diethylbenzene, isopropylbenzene, acylbenzene, p-cymene, naphthalene, tetralin, decalin and biphenyl.

The above-mentioned compounds may be used alone or in combination. Further, those compounds may be used together with other solvents, for example, monochlorobenzene, dichloroethane and dichloromethane.

It is preferable that the content of the above-mentioned compound in the photoconductive layer 35 or the charge transport layer 39 be in the range of 500 to 20,000 ppm with respect to the total weight of the corresponding layer immediately after the drying of the photoconductive layer 35 or the charge transport layer 39. When the above-mentioned compound remains in the obtained photoconductive layer in such an amount, not only the toner deposition on the background of the photoconductor can be effectively prevented, but also the increase in the surface potential of an image portion (light-exposed portion) can be reduced so as to prevent the decrease in image density of the obtained toner image.

The above-mentioned cyclic ether compounds such as tetrahydrofuran, dioxane and tetrahydropyran, and the above-mentioned aromatic compounds such as toluene, benzene and m-xylene are particularly preferable. In particular, tetrahydrofuran is most preferable in the present invention.

Further, according to the present invention, it is preferable that the formation liquid for the photoconductive layer 35 or the charge transport layer 39 be dried at temperature in the range of 80 to 150° C. When the drying temperature is 80° C. or more, the obtained photoconductive layer 35 or the charge transport layer 39 can show sufficient mechanical strength. In addition, when the formation liquid is dried at 150° C. or less, oxidation or deterioration of the employed charge generation material and charge transport material can be inhibited, so that excellent photosensitivity and charging characteristics can be obtained.

With respect to the structure of the photoconductor, it is preferable that an undercoat layer 33 be interposed between the electroconductive support 31 and the photoconductive layer 35 or 35' as shown in FIG. 4 and FIG. 5. Further, it is preferable that the undercoat layer 33 comprise titanium oxide. Since titanium oxide is white and scarcely exhibits the absorption in the wavelength range from the visible light to the near infrared light, so that the addition of titanium oxide is desirable for improvement of the sensitivity of the photoconductor. The refractive index of titanium oxide is relatively large, so that it is possible to effectively prevent the Moiré fringe, which often occurs in the course of image recording by use of coherent light such as a laser beam.

The undercoat layer 33 comprises a binder resin together with the above-mentioned titanium oxide.

Preferable examples of the resin for use in the undercoat layer 33 are thermoplastic resins such as polyvinyl alcohol, casein, sodium polyacrylate, copolymerized nylon and methoxyrnethylated nylon; and thermosetting resins such as polyurethane, melamine resin, epoxy resin, alkyd resin, phenolic resin, butyral resin and unsaturated polyester resin.

In the undercoat layer 33, it is preferable that the ratio by volume of titanium oxide to binder resin be in the range of 0.9/1 to 2/1. When the volume ratio of titanium oxide to the binder resin is 0.9/1 or more, the properties of the undercoat layer are not excessively influenced by the characteristics of the employed binder resin. In particular, it is possible to minimize the change of the photoconductive properties caused by the change in temperature and humidity or by the repeated operations. Further, when the volume ratio of titanium oxide to binder resin is 2/1 or less, the number of voids formed in the undercoat layer is not so extremely increased, that the decrease in the adhesion between, for example, the undercoat layer 33 and the charge generation layer 37 as in FIG. 5, can be prevented. When the volume ratio of titanium oxide to the binder resin is extremely increased, for instance, 3/1 or more, air is accumulated in the undercoat layer 33, which will cause the generation of air bubbles in the photoconductive layer formation liquid in the course of the coating and drying operation of the photoconductive layer formation liquid. Thus, too much titanium oxide in the undercoat layer hinders the coating performance of the photoconductive layer.

It is preferable that the photoconductive layer 35 in FIG. 4 or the charge generation layer 37 in FIG. 5 comprise as a charge generation material a metallo-phthalocyanine compound or metal-free phthalocyanine compound. To be more specific, there can be employed conventional X-type and t-type metal-free phthalocyanine compounds; and metallo-phthalocyanine compounds such as titanyl phthalocyanine, vanadyl phthalocyanine, copper phthalocyanine, hydroxygallium phthalocyanine, chlorogallium phthalocyanine, dichlorotin phthalocyanine, chloroaluminum phthalocyanine and chloroindium phthalocyanine.

The resistivity of the above-mentioned phthalocyanine compound itself is generally low. Although the phthalocyanine compound therefore tends to easily produce defective images such as toner deposition on the background, the traps on the interface between the charge generation layer and the charge transport layer can be filled up by the previously mentioned compound such as a cyclic ether compound remaining in the charge transport layer, thereby increasing the apparent resistivity. Thus, injection of the electric charge into the photoconductive layer can be effectively prevented without any adverse effect on the photosensitivity.

To prepare the electroconductive support 31 for use in the electrophotographic photoconductor, an electroconductive material with a volume resistivity of $10^{10}$ Ω.cm or less, for example, a metal such as aluminum, nickel, chromium, nichrome, copper, gold, silver or platinum; or a metallic oxide such as tin oxide or indium oxide is coated by deposition or sputtering on a supporting material, e.g., a plastic film or a sheet of paper, which may be fabricated in a cylindrical form. Alternatively, a plate of aluminum, aluminum alloy, nickel or stainless steel can be used as the electroconductive support 31; and the above-mentioned metal plate may be made into a tube by extrusion or pultrusion and subjected to surface treatment such as cutting, superfinishing and grinding. In addition, an endless nickel belt and an endless stainless steel belt as disclosed in Japanese Laid-Open Patent Application 52-36016 can be used as the electroconductive support 31.

In addition to the above, the electroconductive support 31 can be obtained in such a manner that electroconductive finely-divided particles are dispersed in an appropriate binder resin, and the thus prepared mixture is coated on the above-mentioned supporting materials.

Specific examples of the above-mentioned electroconductive finely-divided particles for use in the electroconductive layer are carbon black, acetylene black, powder of metals such as aluminum, nickel, iron, nichrome, copper, zinc and silver, and powder of metallic oxides such as electroconductive tin oxide and indium tin oxide (ITO).

Specific examples of the binder resin used with the above-mentioned electroconductive finely-divided particles are thermoplastic, thermosetting and photo-setting resins such as polystyrene, styrene—acrylonitrile copolymer, styrene—butadiene copolymer, styrene—maleic anhydride copolymer, polyester, polyvinyl chloride, vinyl chloride—vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyltoluene, poly-N-vinylcarbazole, acrylic resin, silicone resin, epoxy resin, melamine resin, urethane resin, phenolic resin, and alkyd resin. A mixture of the aforementioned electroconductive finely-divided particles and binder resin may be dispersed in a proper solvent such as tetrahydrofuran, dichloromethane, 2-butanone or toluene, and the thus prepared coating liquid for the electroconductive layer may be coated on the supporting material, thereby obtaining the electroconductive support 31.

In addition, a heat-shrinkable tubing obtained by adding the above-mentioned electroconductive particles to a material such as polyvinyl chloride, polypropylene, polyester, polystyrene, polyvinylidene chloride, polyethylene, chlorinated rubber or polytetrafluoroethylene may be provided on an appropriate cylindrical supporting material to prepare the electroconductive support 31.

The layered photoconductor shown in FIG. 5 will now be explained in detail.

As shown in FIG. 5 the undercoat layer and the photoconductive layer 35' comprising the charge generation layer 37 and the charge transport layer 39 are successively overlaid on the electroconductive support 31.

The undercoat layer 33 may further comprise finely-divided particles of metallic oxide pigments such as aluminum oxide, silica, zirconium oxide, tin oxide and indium oxide in addition to the previously mentioned titanium oxide in order to prevent the occurrence of Moiré fringe and reduce the residual potential.

The undercoat layer 33 may further comprise a silane coupling agent, a titanium coupling agent, a chromium coupling agent, a titanyl chelate compound, a zirconium chelate compound, a titanyl alkoxide compound, and an organic titanyl compound.

The undercoat layer 33 can be formed on the electroconductive support 31 by the conventional coating method using a proper solvent.

In addition to the above, a thin film of $Al_2O_3$ may be deposited as the undercoat layer 33 on the electroconductive support 31 by anodizing process, or a thin film of an organic material such as poly-p-xylylene, or an inorganic material such as $SiO_2$, $SnO_2$, $TiO_2$, ITO or $CeO_2$ may be formed on the electroconductive support 31 by vacuum-film-forming method.

The proper thickness of the undercoat layer 33 is in the range of 0 to 10 $\mu$m.

As the charge generation material for use in the charge generation layer 37, a metal-free phthalocyanine pigment and a metallo-phthalocyanine pigment are preferably employed in the present invention, as mentioned above. In addition, there can be employed the conventional charge generation materials such as azo pigments including a monoazo pigment, a bisazo pigment, an unsymmetrical disazo pigment, a trisazo pigment and tetraazo pigment; pyrrolopyrrole pigment; anthraquinone pigment; perylene pigment; polycyclic quinone pigment; indigo pigment; squarylium pigment; pyrene pigment; diphenylmethane pigment; cyan pigment; and quinoline pigment. The phthalocyanine pigment is effective in the present invention, and the phthalocyanine pigment may be used in combination with the above-mentioned pigments The charge generation layer 37 further comprises a binder resin. Specific examples of the binder resin for use in the charge generation layer 37 are polyurethane, epoxy resin, polyketone, polycarbonate, silicone resin, acrylic resin, polyvinyl butyral, polyvinyl formal, polyvinyl ketone, polystyrene, poly-N-vinylcarbazole, polyacrylamide, polyvinyl benzal, polyester, phenoxy resin, vinyl chloride—vinyl acetate copolymer, polyvinyl acetate, polyphenyleneoxide, polyamide, polyvinylpyridine, cellulose resin, casein, polyvinyl alcohol and polyvinylpyrrolidone. In particular, polyvinyl butyral is most preferable as the binder resin for use in the charge generation layer 37.

It is preferable that the amount of the binder resin for use in the charge generation layer 37 be in the range of 10 to 500 parts by weight, more preferably in the range of 25 to 300 parts by weight, with respect to 100 parts by weight of the charge generation material.

Examples of the solvent used for the formation of the charge generation layer 37 are isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene and ligroine.

The formation liquid for the charge generation layer 37 is prepared by dispersing the previously mentioned charge generation material and binder resin in such a solvent using a ball mill, attritor, sand mill, or ultrasonic wave. The thus prepared charge generation layer formation liquid is applied to the undercoat layer 33 and dried.

The thickness of the charge generation layer 37 is preferably in the range of 0.01 to 5 $\mu$m, more preferably in the range of 0.1 to 2 $\mu$m.

To form the charge transport layer 39 as shown in FIG. 5, a charge transport material and a binder resin are dissolved or dispersed in an appropriate solvent for obtaining a formation liquid for the charge transport layer 39. The thus obtained formation liquid may be coated on the charge generation layer 37 and dried, so that the charge transport layer 39 is provided on the charge generation layer 37. In the present invention, as previously explained, it is preferable that the above-mentioned solvent comprise at least the cyclic ether compound, aromatic hydrocarbon compound or the derivatives thereof. The formation liquid for the charge transport layer 39 may further comprise a plasticizer, a levelling agent and an antioxidant.

The charge transport material for use in the charge transport layer 39 includes a positive hole transport material and an electron transport material.

Examples of the electron transport material are electron acceptor materials such as chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno{1,2-b}thiophen-4-one, 1,3,7-trinitrodibenzothiophene-5,5-dioxide and benzoquinone derivatives.

Examples of the positive hole transport material for use in the present invention are poly-N-vinylcarbazole and derivatives thereof, poly-γ-carbazolyl ethyl glutamate and derivatives thereof, pyrene—formaldehyde condensate and derivatives thereof, polyvinyl pyrene, polyvinyl phenanthrene, polysilane, oxazole derivatives, oxadiazole derivatives, imidazole derivatives, monoarylamine derivatives, diarylamine derivatives, triarylamine derivatives, stilbene derivatives, α-phenyl stilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bis-stilbene derivatives, enamine derivatives, and other conventional polymerized positive hole transport materials.

The above-mentioned charge transport materials may be used alone or in combination.

Examples of the binder resin for use in the charge transport layer 39 are thermoplastic and thermosetting resins such as polystyrene, styrene—acrylonitrile copolymer, styrene—butadiene copolymer, styrene—maleic anhydride copolymer, polyester, polyvinyl chloride, vinyl chloride—vinyl acetate copolymer, polyvinyl acetate, polyvinylidene chloride, polyarylate, phenoxy resin, polycarbonate, cellulose acetate resin, ethyl cellulose resin, polyvinyl butyral, polyvinyl formal, polyvinyltoluene, poly-N-vinylcarbazole, acrylic resin, silicone resin, epoxy resin, melamine resin, urethane resin, phenolic resin, alkyd resin, and various kinds of polycarbonate copolymers disclosed in Japanese Laid-Open Patent Application Nos. 5-158250 and 6-51544.

It is preferable that the amount of the charge transport material in the charge transport layer 39 be in the range of 20 to 300 parts by weight, more preferably in the range of 40 to 150 parts by weight, with respect to 100 parts by weight of the binder resin.

It is preferable that the thickness of the charge transport layer 39 be in the range of 5 to 100 μm.

As mentioned above, the charge transport layer 39 may further comprise a leveling agent and an antioxidant when necessary.

Examples of the leveling agent for use in the charge transport layer 39 are silicone oils such as dimethyl silicone oil and methylphenyl silicone oil; and polymers and oligomers having a perfluoroalkyl group on the side chain thereof. It is preferable that the amount of the leveling agent be in the range of 0 to 1 part by weight to 100 parts by weight of the binder resin for use in the charge transport layer 39.

Examples of the antioxidant for use in the present invention are hindered phenol compounds, sulfur-containing compounds, phosphorus-containing compounds, hindered amine compounds, pyridine derivatives, piperidine derivatives, and morpholine derivatives.

It is proper that the amount of the antioxidant be in the range of 0 to about 5 parts by weight to 100 parts by weight of the binder resin for use in the charge transport layer 39.

The charge generation layer 37 and the charge transport layer 39 can be provided by coating method, for example, dip coating, spray coating, beads coating, nozzle coating, spinner coating, ring coating, Meyer bar coating, roller coating or curtain coating.

The single-layered electrophotographic photoconductor shown in FIG. 4 will now be explained in detail.

The photoconductive layer 35 is formed in such a manner that a charge generation material, a charge transport material and a binder resin are dissolved or dispersed in a proper solvent to prepare a formation liquid for the photoconductive layer 35, and the thus prepared formation liquid is coated on the undercoat layer 33, and dried. According to the present invention, it is preferable that the solvent comprise at least one compound selected from the group consisting of the above-mentioned cyclic ether compound, aromatic hydrocarbon compound, and derivatives thereof. When necessary, the formation liquid for the photoconductive layer 35 may further comprise a leveling agent and an antioxidant.

As the binder resin used for the formation of the above-mentioned single-layered photoconductive layer 35, the same binder resins as mentioned in the formation of the charge transport layer 39 may be used alone, or such binder resins may be used in combination with the binder resins as employed in the formation of the charge generation layer 37.

It is preferable that the amount of charge generation material be in the range of 0.1 to 5 wt. %, more preferably in the range of 0.25 to 2.5 wt. % of the entire solid content of the photoconductive layer 35.

It is preferable that the amount of charge transport material be in the range of 5 to 50 wt. %, more preferably in the range of 10 to 40 wt. % of the entire solid content of the photoconductive layer 35.

The single-layered photoconductive layer 35 shown in FIG. 4 is provided on the undercoat layer 33 by dispersing the charge generation material, the charge transport material, and the binder resin in a solvent which comprises the previously mentioned cyclic ether compound, aromatic hydrocarbon compound or the like using a dispersion mixer to prepare a formation liquid for the photoconductive layer 35. The formation liquid thus prepared is coated on the undercoat layer 33 by dip coating, spray coating or beads coating.

It is preferable that the thickness of the single-layered photoconductive layer 35 be in the range of 5 to 100 μm, more preferably in the range of 10 to 50 μm.

The electrophotographic photoconductor for use in the present invention may further comprise a protective layer which is overlaid on the photoconductive layer 35 or 35' for the purpose of protecting the photoconductive layer 35 or 35'. The protective layer can be provided on the photoconductive layer 35 or 35' using the conventional material by the conventional method. The proper thickness of the protective layer is about 0.1 to 10 μm.

Other features of this invention will become apparent in the course of the following description of exemplary embodiments, which are given for illustration of the invention and are not intended to be limiting thereof.

EXAMPLE I-1

Fabrication of Electrophotographic Photoconductor

Formation of Undercoat Layer

A mixture of the following components was dispersed in a ball mill for 72 hours to prepare an undercoat layer formation liquid:

| | Parts by Weight |
|---|---|
| Titanium oxide (Trademark "CR-EL", made by Ishihara Sangyo Kaisha, Ltd.) | 70 |
| Alkyd resin (Trademark | 15 |

19 parts by weight of a trisazo pigment represented by the following formula (1) and 1 part by weight of a disazo pigment represented by the following formula (2) were added to a resin solution prepared by dissolving 4 parts by weight of the commercially available polyvinyl butyral resin (Trademark "BM-2", made by Sekisui Chemical Co., Ltd.) in 150 parts by weight of cyclohexanone. The resultant mixture was dispersed in a ball mill for 72 hours.

(1)

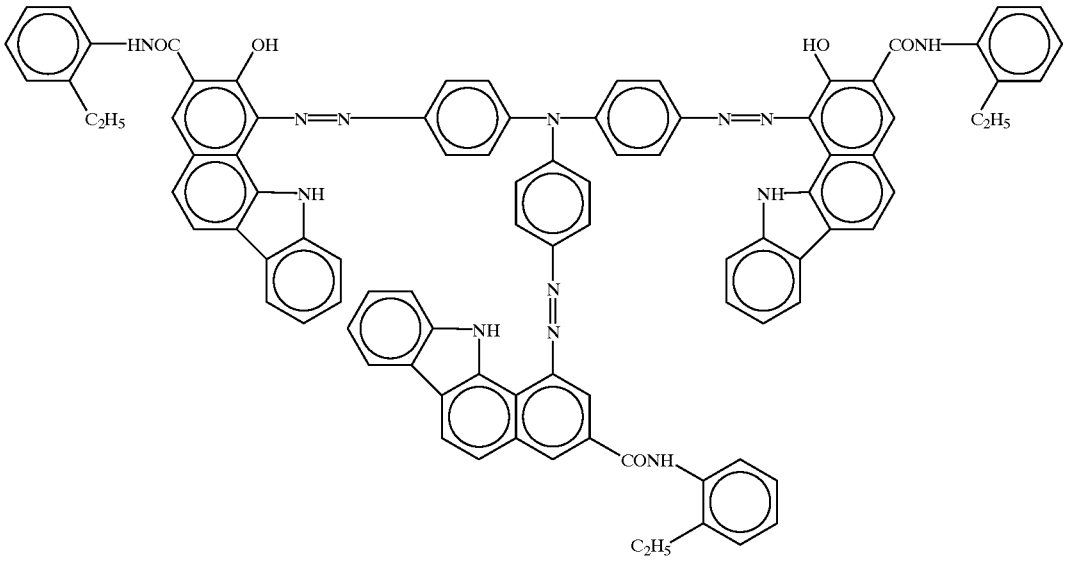

(2)

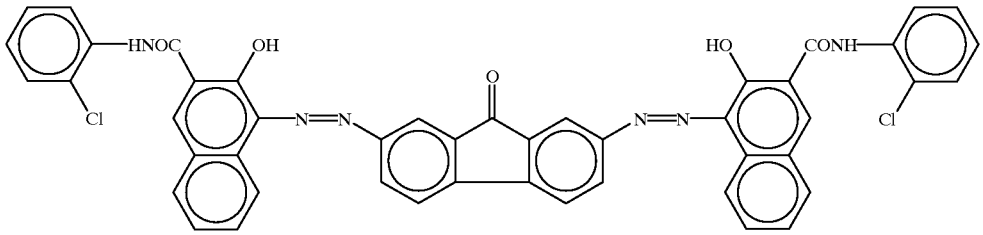

-continued

| | Parts by Weight |
|---|---|
| "Beckolite M6401-50-S" with a solid content of 50%, made by Dainippon Ink & Chemicals, Incorporated) | |
| Melamine resin (Trademark "Super Beckamine L-121-60" with a solid content of 60%, made by Dainippon Ink & Chemicals, Incorporated) | 10 |
| Methyl ethyl ketone | 100 |

The thus prepared formation liquid was coated on the outer surface of an aluminum drum with a diameter of 80 mm and a length of 359 mm, and dried at 130° C. for 20 minutes. Thus, an undercoat layer with a thickness of 3 $\mu$m was provided on the aluminum drum.

Formation of Charge Generation Layer

Thereafter, the mixture was further dispersed for 3 hours with the addition thereto of 210 parts by weight of cyclohexanone, whereby a charge generation layer formation liquid was obtained. The thus obtained formation liquid was coated on the above prepared undercoat layer, and dried at 130° C. for 10 minutes, so that a charge generation layer with a thickness of 0.2 $\mu$m was provided on the undercoat layer.

Formation of Charge Transport Layer

The following components were dissolved in a mixture of 70 parts by weight of dichloromethane and 30 parts by weight of 2-methylfuran, so that a charge transport layer formation liquid was prepared:

| | Parts by Weight |
|---|---|
| Charge transport material of formula (3): | 8 |

-continued

| | Parts by Weight |
|---|---|
| 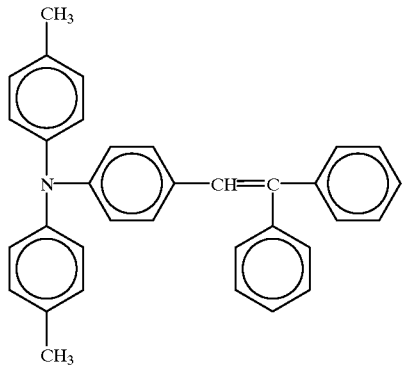 (3) | |
| Z type polycarbonate (viscosity-average molecular weight: 50,000) | 10 |
| Silicone oil (Trademark "KF-50" made by Shin-Etsu Chemical Co., Ltd.) | 0.002 |

The thus prepared formation liquid was coated on the above prepared charge generation layer, and dried at 75° C. for 50 minutes, so that a charge transport layer with a thickness of 30 μm was provided on the charge generation layer.

Thus, an electrophotographic photoconductor No. I-1 for use in the present invention was fabricated.

Then, the above prepared charge transport layer was peeled from the charge generation layer at the end portion of the photoconductor drum, and the amount of solvent remaining in the charge transport layer was measured using a commercially available pyrolysis gas chromatograph (Trademark "GC15A", made by Shimadzu Corporation) and a commercially available Curie point pyrolyzer (Trademark "JHP-35", made by Japan Analytical Industry Co., Ltd.). The measurement was carried out immediately after the drying of the charge transport layer and 24 hours after the drying thereof.

EXAMPLE I-2

The procedure for fabrication of the electrophotographic photoconductor No. I-1 in Example I-1 was repeated except that the drying conditions such as the temperature and the drying period for the formation of the charge transport layer in Example I-1 were changed to 90° C. and 30 minutes, so that an electrophotographic photoconductor No. I-2 for use in the present invention was fabricated.

EXAMPLE I-3

The procedure for fabrication of the electrophotographic photoconductor No. I-1 in Example I-1 was repeated except that the drying conditions such as the temperature and the drying period for the formation of the charge transport layer in Example I-1 were changed to 110° C. and 30 minutes, so that an electrophotographic photoconductor No. I-3 for use in the present invention was fabricated.

EXAMPLE I-4

The procedure for fabrication of the electrophotographic photoconductor No. I-1 in Example I-1 was repeated except that the drying conditions such as the temperature and the drying period for the formation of the charge transport layer in Example I-1 were changed to 130° C. and 30 minutes, so that an electrophotographic photoconductor No. I-4 for use in the present invention was fabricated.

EXAMPLE I-5

The procedure for fabrication of the electrophotographic photoconductor No. I-1 in Example I-1 was repeated except that the drying conditions such as the temperature and the drying period for the formation of the charge transport layer in Example I-1 were changed to 160° C. and 30 minutes, so that an electrophotographic photoconductor No. I-5 for use in the present invention was fabricated.

EXAMPLE I-6

Formation of Undercoat Layer and Charge Generation Layer

The undercoat layer and the charge generation layer were successively overlaid on the aluminum drum in the same manner as in Example I-1.

Formation of Charge Transport Layer

The following components were dissolved in 100 parts by weight of tetrahydrofuran, so that a charge transport layer formation liquid was prepared:

| | Parts by Weight |
|---|---|
| Charge transport material of formula (3): | 7 |
| 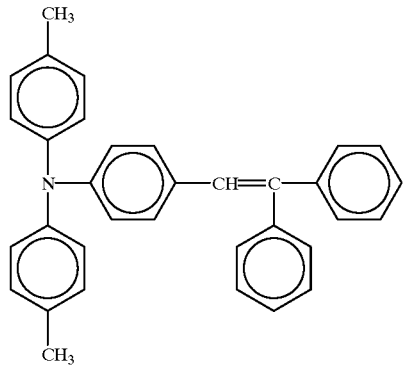 (3) | |
| Z type polycarbonate (viscosity-average molecular weight: 40,000) | 10 |
| Silicone oil (Trademark "KF-50" made by Shin-Etsu Chemical Co., Ltd.) | 0.002 |

The thus prepared formation liquid was coated on the above prepared charge generation layer, and dried at 75° C. for 50 minutes, so that a charge transport layer with a thickness of 30 μm was provided on the charge generation layer.

Thus, an electrophotographic photoconductor No. I-6 for use in the present invention was fabricated.

EXAMPLE I-7

The procedure for fabrication of the electrophotographic photoconductor No. I-2 in Example I-2 was repeated except that the charge transport layer formation liquid employed in Example I-2 was replaced by the charge transport layer formation liquid prepared in Example I-6, so that an electrophotographic photoconductor No. I-7 for use in the present invention was fabricated.

EXAMPLE I-8

The procedure for fabrication of the electrophotographic photoconductor No. I-3 in Example I-3 was repeated except that the charge transport layer formation liquid employed in Example I-3 was replaced by the charge transport layer formation liquid prepared in Example I-6, so that an electrophotographic photoconductor No. I-8 for use in the present invention was fabricated.

EXAMPLE I-9

The procedure for fabrication of the electrophotographic photoconductor No. 1-4 in Example I-4 was repeated except that the charge transport layer formation liquid employed in Example I-4 was replaced by the charge transport layer formation liquid prepared in Example I-6, so that an electrophotographic photoconductor No. I-9 for use in the present invention was fabricated.

EXAMPLE I-10

The procedure for fabrication of the electrophotographic photoconductor No. I-5 in Example I-5 was repeated except that the charge transport layer formation liquid employed in Example I-5 was replaced by the charge transport layer formation liquid prepared in Example I-6, so that an electrophotographic photoconductor No. I-10 for use in the present invention was fabricated.

EXAMPLE I-11

The procedure for fabrication of the electrophotographic photoconductor No. I-6 in Example I-6 was repeated except that tetrahydrofuran used as a solvent for preparing the charge transport layer formation liquid in Example I-6 was replaced by 1,4-dioxane, so that an electrophotographic photoconductor No. I-11 for use in the present invention was fabricated.

EXAMPLE I-12

The procedure for fabrication of the electrophotographic photoconductor No. I-2 in Example I-2 was repeated except that the charge transport layer formation liquid employed in Example I-2 was replaced by the charge transport layer formation liquid prepared in Example I-11, so that an electrophotographic photoconductor No. I-12 for use in the present invention was fabricated.

EXAMPLE I-13

The procedure for fabrication of the electrophotographic photoconductor No. I-3 in Example I-3 was repeated except that the charge transport layer formation liquid employed in Example I-3 was replaced by the charge transport layer formation liquid prepared in Example I-11, so that an electrophotographic photoconductor No. I-13 for use in the present invention was fabricated.

EXAMPLE I-14

The procedure for fabrication of the electrophotographic photoconductor No. I-4 in Example I-4 was repeated except that the charge transport layer formation liquid employed in Example I-4 was replaced by the charge transport layer formation liquid prepared in Example I-11, so that an electrophotographic photoconductor No. I-14 for use in the present invention was fabricated.

EXAMPLE I-15

The procedure for fabrication of the electrophotographic photoconductor No. I-5 in Example I-5 was repeated except that the charge transport layer formation liquid employed in Example I-5 was replaced by the charge transport layer formation liquid prepared in Example I-11 so that an electrophotographic photoconductor No. I-15 for use in the present invention was fabricated.

EXAMPLE I-16

The procedure for fabrication of the electrophotographic photoconductor No. I-6 in Example I-6 was repeated except that tetrahydrofuran used as a solvent for preparing the charge transport layer formation liquid in Example I-6 was replaced by tetrahydropyran, so that an electrophotographic photoconductor No. I-16 for use in the present invention was fabricated.

EXAMPLE I-17

The procedure for fabrication of the electrophotographic photoconductor No. I-2 in Example I-2 was repeated except that the charge transport layer formation liquid in Example I-2 was replaced by the charge transport layer formation liquid prepared in Example I-16, so that an electrophotographic photoconductor No. I-17 for use in the present invention was fabricated.

EXAMPLE I-18

The procedure for fabrication of the electrophotographic photoconductor No. I-3 in Example I-3 was repeated except that the charge transport layer formation liquid in Example I-3 was replaced by the charge transport layer formation liquid prepared in Example I-16, so that an electrophotographic photoconductor No. I-18 for use in the present invention was fabricated.

EXAMPLE I-19

The procedure for fabrication of the electrophotographic photoconductor No. I-4 in Example I-4 was repeated except that the charge transport layer formation liquid in Example I-4 was replaced by the charge transport layer formation liquid prepared in Example I-16, so that an electrophotographic photoconductor No. I-19 for use in the present invention was fabricated.

EXAMPLE I-20

The procedure for fabrication of the electrophotographic photoconductor No. I-5 in Example I-5 was repeated except that the charge transport layer formation liquid in Example I-5 was replaced by the charge transport layer formation liquid prepared in Example I-16, so that an electrophotographic photoconductor No. I-20 for use in the present invention was fabricated.

EXAMPLE I-21

Formation of Undercoat Layer

The undercoat layer was provided on the aluminum drum in the same manner as in Example I-1.

Formation of Charge Generation Layer 20 parts by weight of an A-type titanyl phthalocyanine pigment and 400 parts by weight of methyl ethyl ketone were mixed and ground in a pot for 10 hours together with zirconium oxide balls.

To this mixture, a resin solution prepared by dissolving 10 parts by weight of the commercially available polyvinyl butyral resin (Trademark "XYHL", made by Union Carbide Japan K.K.) in 500 parts by weight of methyl ethyl ketone was added. The resultant mixture was ground in a ball mill for 2 hours, whereby a charge generation layer formation liquid was obtained.

The thus obtained formation liquid was coated on the above prepared undercoat layer, and dried at 70° C. for 10 minutes, so that a charge generation layer with a thickness of 0.3 μm was provided on the undercoat layer.

Formation of Charge Transport Layer

The charge transport layer was provided on the above prepared charge generation layer in the same manner as in Example I-1.

Thus, an electrophotographic photoconductor No. I-21 for use in the present invention was fabricated.

EXAMPLES I-22 TO I-40

The procedure for fabrication of each of the electrophotographic photoconductors Nos. I-2 to I-20 respectively fabricated in Examples I-2 to I-20 was repeated except that the charge generation layer formation liquid employed in each Example was replaced by the charge generation layer formation liquid prepared in Example I-21, so that electrophotographic photoconductors No. I-22 to No. I-40 for use in the present invention were fabricated.

Comparative Example 1

The procedure for fabrication of the electrophotographic photoconductor No. I-6 in Example I-6 was repeated except that tetrahydrofuran used as a solvent for preparing the charge transport layer formation liquid in Example I-6 was replaced by dichloromethane, so that a comparative electrophotographic photoconductor No. 1 was fabricated.

Comparative Example 2

The procedure for fabrication of the electrophotographic photoconductor No. I-7 in Example I-7 was repeated except that tetrahydrofuran used as a solvent for preparing the charge transport layer formation liquid in Example I-7 was replaced by dichloromethane, so that a comparative electrophotographic photoconduczor No. 2 was fabricated.

Comparative Example 3

The procedure for fabrication of the electrophotographic photoconductor No. I-8 in Example I-8 was repeated except that tetrahydrofuran used as a solvent for preparing the charge transport layer formation liquid in Example I-8 was replaced by dichloromethane, so that a comparative electrophotographic photoconductor No. 3 was fabricated.

Comparative Example 4

The procedure for fabrication of the electrophotographic photoconductor No. I-9 in Example I-9 was repeated except that tetrahydrofuran used as a solvent for preparing the charge transport layer formation liquid in Example I-9 was replaced by dichloromethane, so that a comparative electrophotographic photoconductor No. 4 was fabricated.

Comparative Example 5

The procedure for fabrication of the electrophotographic photoconductor NO. I-10 in Example I-10 was repeated except that tetrahydrofuran used as a solvent for preparing the charge transport layer formation liquid in Example I-10 was replaced by dichloromethane, so that a comparative electrophotographic photoconductor No. 5 was fabricated.

Comparative Example 6

The procedure for fabrication of the electrophotographic photoconductor No. I-6 in Example I-6 was repeated except that tetrahydrofuran used as a solvent for preparing the charge transport layer formation liquid in Example I-6 was replaced by dichloroethane, so that a comparative electrophotographic photoconductor No. 6 was fabricated.

Comparative Example 7

The procedure for fabrication of the electrophotographic photoconductor No. I-7 in Example I-7 was repeated except that tetrahydrofuran used as a solvent for preparing the charge transport layer formation liquid in Example I-7 was replaced by dichloroethane, so that a comparative electrophotographic photoconductor No. 7 was fabricated.

Comparative Example 8

The procedure for fabrication of the electrophotographic photoconductor No. I-8 in Example I-8 was repeated except that tetrahydrofuran used as a solvent for preparing the charge transport layer formation liquid in Example I-8 was replaced by dichloroethane, so that a comparative electrophotographic photoconductor No. 8 was fabricated.

Comparative Example 9

The procedure for fabrication of the electrophotographic photoconductor No. I-9 in Example I-9 was repeated except that tetrahydrofuran used as a solvent for preparing the charge transport layer formation liquid in Example I-9 was replaced by dichloroethane, so that a comparative electrophotographic photoconductor No. 9 was fabricated.

Comparative Example 10

The procedure for fabrication of the electrophotographic photoconductor No. I-10 in Example I-10 was repeated except that tetrahydrofuran used as a solvent for preparing the charge transport layer formation liquid in Example I-10 was replaced by dichloroethane, so that a comparative electrophotographic photoconductor No. 10 was fabricated.

Comparative Example 11

The procedure for fabrication of the electrophotographic photoconductor No. I-6 in Example I-6 was repeated except that tetrahydrofuran used as a solvent for preparing the charge transport layer formation liquid in Example I-6 was replaced by chloroform, so that a comparative electrophotographic photoconductor No. 11 was fabricated.

Comparative Example 12

The procedure for fabrication of the electrophotographic photoconductor No. I-7 in Example I-7 was repeated except that tetrahydrofuran used as a solvent for preparing the charge transport layer formation liquid in Example I-7 was replaced by chloroform, so that a comparative electrophotographic photoconductor No. 12 was fabricated.

Comparative Example 13

The procedure for fabrication of the electrophotographic photoconductor No. I-8 in Example I-8 was repeated except that tetrahydrofuran used as a solvent for preparing the charge transport layer formation liquid in Example I-8 was replaced by chloroform, so that a comparative electrophotographic photoconductor No. 13 was fabricated.

Comparative Example 14

The procedure for fabrication of the electrophotographic photoconductor No. I-9 in Example I-9 was repeated except that tetrahydrofuran used as a solvent for preparing the charge transport layer formation liquid in Example I-9 was replaced by chloroform, so that a comparative electrophotographic photoconductor No. 14 was fabricated.

Comparative Example 15

The procedure for fabrication of the electrophotographic photoconductor No. I-10 in Example I-10 was repeated except that tetrahydrofuran used as a solvent for preparing the charge transport layer formation liquid in Example I-10 was replaced by chloroform, so that a comparative electrophotographic photoconductor No. 15 was fabricated.

Measurement of Content of Solvent in CTL

The content of the solvent remaining in the charge transport layer was measured in the same manner as described in Example I-1.

Image Formation Test

Each of the electrophotographic photoconductors Nos. I-1 to I-40 respectively fabricated in Examples I-1 to I-40 and the comparative electrophotographic photoconductors Nos. 1 to 15 respectively fabricated in Comparative Examples 1 to 15 was placed in a commercially available copying machine (Trademark "IMAGIO MF530", made by Ricoh Company, Ltd.).

Under the circumstances of 30° C. and 80% RH, 100,000 copies were continuously made on recording sheets using a chart including a solid image with an area ratio of 5%. The surface potentials of a background (non-image) area (Vw) and an image area (VL) were measured at the initial stage of the continuous copying operation and after making of 100,000 copies.

Further, the image quality was evaluated. To be more specific, when one or more black spots (toner deposition) with diameter of 0.1 mm or more were observed within an area of 1 $cm^2$ of the background of a recording sheet, the number of recording sheets which had been already subjected to continuous copying operation was counted. The occurrence of toner deposition on the background of the recording sheet was expressed by the number of recording sheets thus counted.

In addition, occurrence of abnormal image caused by the crack on the photoconductor was visually inspected.

The results are shown in TABLE 1 to TABLE 3.

TABLE 1

| | | | | | | | Image Formation Test | | | | | |
|---|---|---|---|---|---|---|---|---|---|---|---|---|
| | | | | | | | Initial Stage | | After making of 100,000 copies | | Occurrence | |
| | | | Drying Conditons | Content of Residual Solvent (ppm) | | Change Ratio of | Potential | Potential | Potential | Potential | of Toner | Occur- |
| Example No. | CGM(*) | Solvent of CTL(**) Coating Liquid | of CTL Coating Liquid (° C.) × (min) | Immediately after drying | 24 hours after drying | Residual Solvent Content (%) | of image area (−V) | of background (−V) | of image area (−V) | of background (−V) | Deposition (No. of sheets) | rence of Abnormal Image |
| I-1 | Azo pigments (1)/(2) = 19/1 | Dichloromethane/2-methylfuran | 75 × 50 | 23400 | 21400 | 8.547 | 160 | 890 | 200 | 920 | 78,000 | None |
| I-2 | | | 90 × 30 | 16500 | 15300 | 7.273 | 160 | 880 | 190 | 870 | 69,000 | None |
| I-3 | | | 110 × 30 | 6400 | 5800 | 9.375 | 130 | 880 | 150 | 885 | 48,000 | None |
| I-4 | | | 130 × 30 | 320 | 300 | 6.250 | 100 | 850 | 130 | 860 | 45,000 | None |
| I-5 | | | 160 × 30 | 15 | 15 | 0.000 | 180 | 860 | 130 | 750 | 32,000 | None |
| I-6 | | Tetrahydrofuran | 75 × 50 | 25000 | 24500 | 2.000 | 150 | 880 | 200 | 880 | 95,000 | None |
| I-7 | | | 90 × 30 | 18300 | 17900 | 2.186 | 120 | 875 | 130 | 870 | 93,000 | None |
| I-8 | | | 110 × 30 | 7700 | 7400 | 3.896 | 100 | 860 | 100 | 860 | 92,000 | None |
| I-9 | | | 130 × 30 | 550 | 530 | 3.636 | 100 | 850 | 100 | 845 | 92,000 | None |
| I-10 | | | 160 × 30 | 20 | 20 | 0.000 | 140 | 860 | 140 | 855 | 97,000 | None |
| I-11 | | 1,4-dioxane | 75 × 50 | 30200 | 28500 | 5.629 | 190 | 870 | 220 | 890 | 91,000 | None |
| I-12 | | | 90 × 30 | 19700 | 18500 | 6.091 | 150 | 860 | 180 | 850 | 85,000 | None |
| I-13 | | | 110 × 30 | 10100 | 9600 | 4.950 | 100 | 870 | 120 | 860 | 77,000 | None |
| I-14 | | | 130 × 30 | 1050 | 1000 | 4.762 | 95 | 850 | 110 | 840 | 62,000 | None |
| I-15 | | | 160 × 30 | 15 | 15 | 0.000 | 175 | 855 | 110 | 840 | 59,000 | None |
| I-16 | | Tetrahydropyran | 75 × 50 | 24300 | 22400 | 7.819 | 150 | 875 | 190 | 895 | 84,000 | None |
| I-17 | | | 90 × 30 | 17400 | 16500 | 5.172 | 140 | 865 | 180 | 875 | 71,000 | None |
| I-18 | | | 110 × 30 | 8300 | 7700 | 7.229 | 100 | 850 | 120 | 850 | 59,000 | None |
| I-19 | | | 130 × 30 | 620 | 570 | 8.065 | 100 | 850 | 120 | 840 | 51,000 | None |
| I-20 | | | 160 × 30 | 35 | 35 | 0.000 | 155 | 840 | 90 | 815 | 48,000 | None |

(*) CGM denotes "change generation material".

(**) CTL denotes "change transport layer".

TABLE 2

| Example No. | CGM | Solvent of CTL Coating Liquid | Drying Conditons of CTL Coating Liquid (° C.) × (min) | Content of Residual Solvent (ppm) Immediately after drying | Content of Residual Solvent (ppm) 24 hours after drying | Change Ratio of Residual Solvent Content (%) | Image Formation Test: Initial Stage Potential of image area (−V) | Image Formation Test: Initial Stage Potential of background (−V) | Image Formation Test: After making of 100,000 copies Potential of image area (−V) | Image Formation Test: After making of 100,000 copies Potential of background (−V) | Image Formation Test: Occurrence of Toner Deposition (No. of sheets) | Image Formation Test: Occurrence of Abnormal Image |
|---|---|---|---|---|---|---|---|---|---|---|---|---|
| I-21 | Titanyl phthalocyanine pigment | Dichloromethane/2-methylfuran | 75 × 50 | 23400 | 21400 | 8.547 | 135 | 860 | 175 | 865 | 91,000 | None |
| I-22 | | | 90 × 30 | 16500 | 15300 | 7.273 | 120 | 860 | 140 | 870 | 82,000 | None |
| I-23 | | | 110 × 30 | 6400 | 5800 | 9.375 | 85 | 850 | 100 | 850 | 79,000 | None |
| I-24 | | | 130 × 30 | 320 | 300 | 6.250 | 70 | 850 | 90 | 840 | 79,000 | None |
| I-25 | | | 160 × 30 | 15 | 15 | 0.000 | 130 | 870 | 90 | 850 | 64,000 | None |
| I-26 | | Tetrahydrofuran | 75 × 50 | 25000 | 24500 | 2.000 | 150 | 845 | 160 | 846 | 100,000 | None |
| I-27 | | | 90 × 30 | 18300 | 17900 | 2.186 | 100 | 840 | 110 | 845 | 100,000 | None |
| I-28 | | | 110 × 30 | 7700 | 7400 | 3.896 | 90 | 850 | 95 | 850 | 100,000 | None |
| I-29 | | | 130 × 30 | 550 | 530 | 3.636 | 95 | 845 | 100 | 850 | 97,000 | None |
| I-30 | | | 160 × 30 | 20 | 20 | 0.000 | 120 | 850 | 110 | 840 | 95,000 | None |
| I-31 | | 1,4-dioxane | 75 × 50 | 30200 | 28500 | 5.629 | 170 | 855 | 210 | 860 | 98,000 | None |
| I-32 | | | 90 × 30 | 19700 | 18500 | 6.091 | 120 | 845 | 150 | 850 | 95,000 | None |
| I-33 | | | 110 × 30 | 10100 | 9600 | 4.950 | 100 | 830 | 120 | 840 | 94,000 | None |
| I-34 | | | 130 × 30 | 1050 | 1000 | 4.762 | 85 | 830 | 100 | 830 | 93,000 | None |
| I-35 | | | 160 × 30 | 15 | 15 | 0.000 | 130 | 850 | 90 | 840 | 87,000 | None |
| I-36 | | Tetrahydropyran | 75 × 50 | 24300 | 22400 | 7.819 | 140 | 860 | 180 | 865 | 99,000 | None |
| I-37 | | | 90 × 30 | 17400 | 16500 | 5.172 | 120 | 860 | 150 | 860 | 93,000 | None |
| I-38 | | | 110 × 30 | 8300 | 7700 | 7.229 | 95 | 850 | 115 | 840 | 95,000 | None |
| I-39 | | | 130 × 30 | 620 | 500 | 8.065 | 85 | 860 | 90 | 850 | 82,000 | None |
| I-40 | | | 160 × 30 | 35 | 35 | 0.000 | 115 | 865 | 95 | 820 | 79,000 | None |

TABLE 3

| Comparative Example No. | CGM | Solvent of CTL Coating Liquid | Drying Conditons of CTL Coating Liquid (° C.) × (min) | Content of Residual Solvent (ppm) Immediately after drying | Content of Residual Solvent (ppm) 24 hours after drying | Change Ratio of Residual Solvent Content (%) | Image Formation Test: Initial Stage Potential of image area (−V) | Image Formation Test: Initial Stage Potential of background (−V) | Image Formation Test: After making of 100,000 copies Potential of image area (−V) | Image Formation Test: After making of 100,000 copies Potential of background (−V) | Image Formation Test: Occurrence of Toner Deposition (No. of sheets) | Image Formation Test: Occurrence of Abnormal Image |
|---|---|---|---|---|---|---|---|---|---|---|---|---|
| 1 | (1)/(2) = 19/1 | Dichloromethane | 75 × 50 | 44100 | 24800 | 43.764 | 220 | 830 | 370 | 850 | 75,000 | Note 1 |
| 2 | | | 90 × 30 | 23800 | 14500 | 39.076 | 190 | 840 | 250 | 815 | 62,000 | Note 2 |
| 3 | | | 110 × 30 | 6500 | 4500 | 30.769 | 150 | 850 | 190 | 770 | 35,000 | Note 3 |
| 4 | | | 130 × 30 | 520 | 350 | 32.692 | 110 | 840 | 130 | 715 | 21,000 | Note 3 |
| 5 | | | 160 × 30 | 10 | 5 | 50.000 | 95 | 830 | 100 | 640 | 18,000 | Note 3 |
| 6 | (1)/(2) = 19/1 | Dichloroethane | 75 × 50 | 50500 | 27000 | 46.535 | 250 | 830 | 360 | 845 | 82,000 | Note 1 |
| 7 | | | 90 × 30 | 24800 | 13900 | 43.952 | 220 | 840 | 320 | 825 | 63,000 | Note 1 |
| 8 | | | 110 × 30 | 5700 | 3900 | 31.579 | 140 | 850 | 200 | 755 | 37,000 | Note 3 |
| 9 | | | 130 × 30 | 520 | 370 | 28.846 | 110 | 840 | 130 | 710 | 18,000 | Note 3 |
| 10 | | | 160 × 30 | 20 | 10 | 50.000 | 95 | 830 | 100 | 645 | 12,000 | Note 3 |
| 11 | (1)/(2) = 19/1 | Chloroform | 75 × 50 | 23400 | 16500 | 29.487 | 220 | 830 | 280 | 750 | 32,000 | Note 2 |
| 12 | | | 90 × 30 | 15500 | 12700 | 18.065 | 190 | 840 | 230 | 725 | 30,000 | Note 2 |
| 13 | | | 110 × 30 | 3200 | 2800 | 12.500 | 150 | 850 | 190 | 705 | 18,000 | Note 4 |
| 14 | | | 130 × 30 | 250 | 210 | 16.000 | 110 | 840 | 130 | 680 | 12,000 | Note 3 |
| 15 | | | 160 × 30 | 25 | 10 | 60.000 | 95 | 830 | 100 | 640 | 5,000 | Note 3 |

Note 1: A solid image because blurred.
Note 2: The image density of a solid image was slightly decreased.
Note 3: Toner deposition occurred in the entire background area.
Note 4: The background area was slightly stained with toner deposition.

EXAMPLE I-41

The procedure for fabrication of the electrophotographic photoconductor No. I-3 in Example I-3 was repeated except that the aluminum drum with a diameter of 80 mm and a length of 359 mm, serving as the electroconductive support, used in Example I-3 was replaced by an aluminum drum with a diameter of 30 mm and a length of 340 mm.

Thus, an electrophotographic photoconductor No. I-41 for use in the present invention was fabricated.

EXAMPLES I-42 TO I-46

The procedure for fabrication of each of the electrophotographic photoconductors Nos. I-6 to I-10 respectively fabricated in Examples I-6 to I-10 was repeated except that the aluminum drum with a diameter of 80 mm and a length of 359 mm, serving as the electroconductive support, used in each Example was replaced by an aluminum drum with a diameter of 30 mm and a length of 340 mm.

Thus, electrophotographic photoconductors Nos. I-42 to I-46 for use in the present invention were fabricated.

EXAMPLE I-47

The procedure for fabrication of the electrophotographic photoconductor No. I-13 in Example I-13 was repeated except that the aluminum drum with a diameter of 80 mm and a length of 359 mm, serving as the electroconductive support, used in Example I-13 was replaced by an aluminum drum with a diameter of 30 mm and a length of 340 mm.

Thus, an electrophotographic photoconductor No. I-47 for use in the present invention was fabricated.

EXAMPLE I-48

The procedure for fabrication of the electrophotographic photoconductor No. I-18 in Example I-18 was repeated except that the aluminum drum with a diameter of 80 mm and a length of 359 mm, serving as the electroconductive support, used in Example I-18 was replaced by an aluminum drum with a diameter of 30 mm and a length of 340 mm.

Thus, an electrophotographic photoconductor No. I-48 for use in the present invention was fabricated.

EXAMPLE I-49

The procedure for fabrication of the electrophotographic photoconductor No. I-23 in Example I-23 was repeated except that the aluminum drum with a diameter of 80 mm and a length of 359 mm, serving as the electroconductive support, used in Example I-23 was replaced by an aluminum drum with a diameter of 30 mm and a length of 340 mm.

Thus, an electrophotographic photoconductor No. I-49 for use in the present invention was fabricated.

EXAMPLES I-50 TO I-54

The procedure for fabrication of each of the electrophotographic photoconductors Nos. I-26 to I-30 respectively fabricated in Examples I-26 to I-30 was repeated except that the aluminum drum with a diameter of 80 mm and a length of 359 mm, serving as the electroconductive support, used in each Example was replaced by an aluminum drum with a diameter of 30 mm and a length of 340 mm.

Thus, electrophotographic photoconductors Nos. I-50 to I-54 for use in the present invention were fabricated.

EXAMPLE I-55

The procedure for fabrication of the electrophotographic photoconductor No. I-33 in Example I-33 was repeated except that the aluminum drum with a diameter of 80 mm and a length of 359 mm, serving as the electroconductive support, used in Example I-33 was replaced by an aluminum drum with a diameter of 30 mm and a length of 340 mm.

Thus, an electrophotographic photoconductor No. I-55 for use in the present invention was fabricated.

EXAMPLE I-56

The procedure for fabrication of the electrophotographic photoconductor No. I-38 in Example I-38 was repeated except that the aluminum drum with a diameter of 80 mm and a length of 359 mm, serving as the electroconductive support, used in Example I-38 was replaced by an aluminum drum with a diameter of 30 mm and a length of 340 mm.

Thus, an electrophotographic photoconductor No. I-56 for use in the present invention was fabricated.

Comparative Examples 16 to 30

The procedure for fabrication of each of the comparative electrophotographic photoconductors Nos. 1 to 5 respectively fabricated in Comparative Examples 1 to 5 was repeated except that the aluminum drum with a diameter of 80 mm and a length of 359 mm, serving as the electroconductive support, used in each Example was replaced by an aluminum drum with a diameter of 30 mm and a length of 340 mm.

Thus, comparative electrophotographic photoconductors Nos. 16 to 30 were fabricated.

Measurement of Content of Solvent in CTL

The content of the remaining solvent in the charge transport layer was measured in the same manner as described in Example I-1.

Image Formation Test

Each of the electrophotographic photoconductors Nos. I-41 to I-56 respectively fabricated in Examples I-41 to I-56 and the comparative electrophotographic photoconductors Nos. 16 to 30 respectively fabricated in Comparative Examples 16 to 30 was placed in a commercially available copying machine (Trademark "IMAGIO MF200", made by Ricoh Company, Ltd.) equipped with a charging roller.

Under the circumstances of 30° C. and 80% RH, 50,000 copies were continuously made on recording sheets using a chart including a solid image with an area ratio of 5%. The surface potentials of a background (non-image) area (Vw) and an image area (VL) were measured at the initial stage of the continuous copying operation and after making of 50,000 copies.

Further, the image quality was evaluated. To be more specific, when one or more black spots (toner deposition) with a diameter of 0.1 mm or more were observed within an area of 1 $cm^2$ of the background of a recording sheet, the number of recording sheets which had been already subjected to continuous copying operation was counted. The occurrence of toner deposition on the background of the recording sheet was expressed by the number of recording sheets thus counted.

In addition, occurrence of abnormal image caused by the crack on the photoconductor was visually inspected.

The results are shown in TABLE 4 and TABLE 5.

TABLE 4

| Example No. | CGM | Solvent of CTL Coating Liquid | Drying Conditons of CTL Coating Liquid (° C.) × (min) | Content of Residual Solvent (ppm) Immediately after drying | Content of Residual Solvent (ppm) 24 hours after drying | Change Ratio of Residual Solvent Content (%) | Image Formation Test: Initial Stage Potential of image area (−V) | Image Formation Test: Initial Stage Potential of background (−V) | Image Formation Test: After making of 50,000 copies Potential of image area (−V) | Image Formation Test: After making of 50,000 copies Potential of background (−V) | Image Formation Test: Occurrence of Toner Deposition (No. of sheets) | Image Formation Test: Occurrence of Abnormal Image |
|---|---|---|---|---|---|---|---|---|---|---|---|---|
| I-41 | (1)/(2) = 19/1 | Dichloromethane/2-methylfuran | 110 × 30 | 6400 | 5800 | 9.375 | 140 | 910 | 150 | 930 | 25,000 | None |
| I-42 | | Tetrahydrofuran | 75 × 50 | 25000 | 24500 | 2.000 | 210 | 920 | 230 | 940 | 48,000 | None |
| I-43 | | | 90 × 30 | 18300 | 17900 | 2.186 | 180 | 900 | 190 | 910 | 45,000 | None |
| I-44 | | | 110 × 30 | 7700 | 7400 | 3.896 | 140 | 910 | 130 | 900 | 45,000 | None |
| I-45 | | | 130 × 30 | 550 | 530 | 3.636 | 110 | 900 | 110 | 900 | 45,000 | None |
| I-46 | | | 160 × 30 | 20 | 20 | 0.000 | 140 | 880 | 110 | 850 | 41,000 | None |
| I-47 | | 1,4-dioxane | 110 × 30 | 10100 | 9600 | 4.950 | 150 | 900 | 170 | 890 | 41,000 | None |
| I-48 | | Tetrahydropyran | 110 × 30 | 8300 | 7700 | 7.229 | 135 | 890 | 145 | 900 | 37,000 | None |
| I-49 | Titanyl phthalocyanine pigment | Dichloromethane/2-methylfuran | 110 × 30 | 6400 | 5800 | 9.375 | 140 | 910 | 150 | 920 | 36,000 | None |
| I-50 | | Tetrahydrofuran | 75 × 50 | 25000 | 24500 | 2.000 | 170 | 910 | 170 | 915 | 50,000 | None |
| I-51 | | | 90 × 30 | 18300 | 17900 | 2.186 | 160 | 920 | 160 | 915 | 50,000 | None |
| I-52 | | | 110 × 30 | 7700 | 7400 | 3.896 | 140 | 895 | 140 | 900 | 50,000 | None |
| I-53 | | | 130 × 30 | 550 | 530 | 3.636 | 120 | 900 | 120 | 910 | 50,000 | None |
| I-54 | | | 160 × 30 | 20 | 20 | 0.000 | 150 | 880 | 140 | 890 | 50,000 | None |
| I-55 | | 1,4-dioxane | 110 × 30 | 10100 | 9600 | 4.950 | 130 | 900 | 140 | 910 | 37,000 | None |
| I-56 | | Tetrahydropuran | 110 × 30 | 8300 | 7700 | 7.229 | 130 | 910 | 145 | 925 | 36,000 | None |

TABLE 5

| Comparative Example No. | CGM | Solvent of CTL Coating Liquid | Drying Conditons of CTL Coating Liquid (° C.) × (min) | Content of Residual Solvent (ppm) Immediately after drying | Content of Residual Solvent (ppm) 24 hours after drying | Change Ratio of Residual Solvent Content (%) | Image Formation Test: Initial Stage Potential of image area (−V) | Image Formation Test: Initial Stage Potential of background (−V) | Image Formation Test: After making of 50,000 copies Potential of image area (−V) | Image Formation Test: After making of 50,000 copies Potential of background (−V) | Image Formation Test: Occurrence of Toner Deposition (No. of sheets) | Image Formation Test: Occurrence of Abnormal Image |
|---|---|---|---|---|---|---|---|---|---|---|---|---|
| 16 | (1)/(2) = 19/1 | Dichloromethane | 75 × 50 | 44100 | 24800 | 43.764 | 210 | 910 | 400 | 950 | — | Note 5 |
| 17 | | | 90 × 30 | 23800 | 14500 | 39.076 | 180 | 910 | 250 | 920 | 22,000 | None |
| 18 | | | 110 × 30 | 6500 | 4500 | 30.769 | 140 | 890 | 140 | 910 | 14,000 | None |
| 19 | | | 130 × 30 | 520 | 350 | 32.692 | 100 | 910 | 100 | 940 | 12,000 | None |
| 20 | | | 160 × 30 | 10 | 5 | 50.000 | 70 | 900 | 120 | 950 | 5,000 | Note 6 |
| 21 | (1)/(2) = 19/1 | Dichloroethane | 75 × 50 | 50500 | 27000 | 46.535 | 220 | 830 | 270 | 750 | — | Note 3 |
| 22 | | | 90 × 30 | 24800 | 13900 | 43.952 | 190 | 840 | 230 | 725 | — | Note 3 |
| 23 | | | 110 × 30 | 5700 | 3900 | 31.579 | 150 | 850 | 150 | 725 | — | Note 3 |
| 24 | | | 130 × 30 | 520 | 370 | 28.846 | 110 | 840 | 110 | 715 | — | Note 3 |
| 25 | | | 160 × 30 | 20 | 10 | 50.000 | 95 | 830 | 100 | 640 | — | Note 3 |
| 26 | (1)/(2) = 19/1 | Chloroform | 75 × 50 | 23400 | 16500 | 29.487 | 220 | 830 | 370 | 850 | 75,000 | Note 5 |
| 27 | | | 90 × 30 | 15500 | 12700 | 18.065 | 190 | 840 | 350 | 850 | 72,000 | Note 7 |
| 28 | | | 110 × 30 | 3200 | 2800 | 12.500 | 150 | 850 | 300 | 850 | 35,000 | Note 7 |
| 29 | | | 130 × 30 | 250 | 210 | 16.000 | 110 | 840 | 320 | 845 | 21,000 | Note 7 |
| 30 | | | 160 × 30 | 25 | 10 | 60.000 | 95 | 830 | 280 | 850 | 18,000 | Note 7 |

Note 3: Toner deposition occurred in the entire background area.
Note 5: A solid image became blurred at the initial stage.
Note 6: Toner deposition of the entire background area was observed after making of 5,000 copies.
Note 7: The image density of a solid image was considerably decreased.

In Examples I-1 to I-56, as can be seen from the results shown in TABLE 1 to TABLE 5, the change in the content of the solvent remaining in the charge transport layer is 10% or less 24 hours after the drying operation. In this case, the surface potentials of an image area and a background area are stable and the occurrence of toner deposition on the background can be efficiently prevented during the continuous image forming operation.

In particular, the above-mentioned advantages of the present invention are remarkably striking (i) when the solvent for use in the charge transport layer formation liquid comprises a cyclic ether compound such as tetrahydrofuran, 1,4-dioxane or tetrahydropyran, (ii) when the content of the remaining cyclic ether compound employed as the solvent is in the range of 500 to 20,000 ppm with respect to the total weight of the charge transport layer immediately after the drying thereof, (iii) the charge transport layer is dried at 80 to 150° C., (iv) the undercoat layer comprises titanium oxide and a binder resin, and (v) the charge generation layer comprises a metal-free phthalocyanine compound or metallo-phthalocyanine compound.

Furthermore, it has been found that the same effects can be obtained when the photoconductor is charged using a charger which is disposed in contact with the photoconductor.

EXAMPLE II-1

Fabrication of Electrophotographic Photoconductor

Formation of Undercoat Layer and Charge Generation Layer

The undercoat layer and the charge generation layer were successively overlaid on the aluminum drum in the same manner as in Example I-1.

Formation of Charge Transport Layer

The following components were dissolved in a mixture of 80 parts by weight of dichloromethane and 20 parts by weight of ethylbenzene, so that a charge transport layer formation liquid was prepared:

| | Parts by Weight |
|---|---|
| Charge transport material of formula (3): | 8 |
| Z type polycarbonate (viscosity-average molecular weight: 50,000) | 10 |
| Silicone oil (Trademark "KF-50" made by Shin-Etsu Chemical Co., Ltd.) | 0.002 |

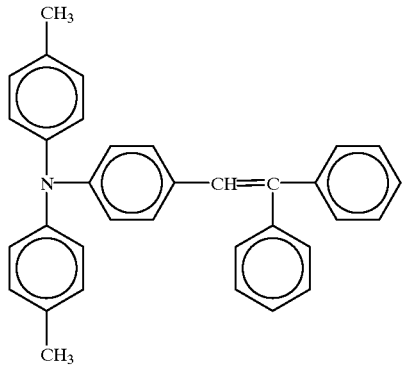

(3)

The thus prepared formation liquid was coated on the above prepared charge generation layer, and dried at 75° C. for 50 minutes, so that a charge transport layer with a thickness of 30 μm was provided on the charge generation layer.

Thus, an electrophotographic photoconductor No. II-1 for use in the present invention was fabricated.

EXAMPLE II-2

The procedure for fabrication of the electrophotographic photoconductor No. II-1 in Example II-1 was repeated except that the drying conditions such as the temperature and the drying period for the formation of the charge transport layer in Example II-1 were changed to 90° C. and 30 minutes, so that an electrophotographic photoconductor No II-2 for use in the present invention was fabricated.

EXAMPLE II-3

The procedure for fabrication of the electrophotographic photoconductor No. II-1 in Example II-1 was repeated except that the drying conditions such as the temperature and the drying period for the formation of the charge transport layer in Example II-1 were changed to 110° C. and 30 minutes, so that an electrophotographic photoconductor No. II-3 for use in the present invention was fabricated.

EXAMPLE II-4

The procedure for fabrication of the electrophotographic photoconductor No. II-1 in Example II-1 was repeated except that the drying conditions such as the temperature and the drying period for the formation of the charge transport layer in Example II-1 were changed to 130° C. and 30 minutes, so that an electrophotographic photoconductor No. II-4 for use in the present invention was fabricated.

EXAMPLE II-5

The procedure for fabrication of the electrophotographic photoconductor No. II-1 in Example II-1 was repeated except that the drying conditions such as the temperature and the drying period for the formation of the charge transport layer in Example II-1 were changed to 160° C. and 30 minutes, so that an electrophotographic photoconductor No. II-5 for use in the present invention was fabricated.

EXAMPLE II-6

Formation of Undercoat Layer and Charge Generation Layer

The undercoat layer and the charge generation layer were successively overlaid on the aluminum drum in the same manner as in Example II-1.

Formation of Charge Transport Layer

The following components were dissolved in 100 parts by weight of toluene, so that a charge transport layer formation liquid was prepared:

| | Parts by Weight |
|---|---|
| Charge transport material of formula (3): | 7 |

-continued

| | Parts by Weight |
|---|---|
| 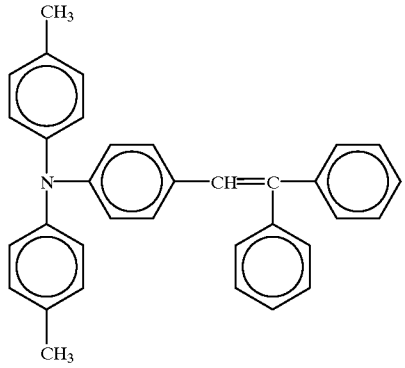 (3) | |
| Z type polycarbonate (viscosity-average molecular weight: 40,000) | 10 |
| Silicone oil (Trademark "KF-50" made by Shin-Etsu Chemical Co., Ltd.) | 0.002 |

The thus prepared formation liquid was coated on the above prepared charge generation layer, and dried at 75° C. for 50 minutes, so that a charge transport layer with a thickness of 30 $\mu$m was provided on the charge generation layer.

Thus, an electrophotographic photoconductor No. II-6 for use in the present invention was fabricated.

EXAMPLE II-7

The procedure for fabrication of the electrophotographic photoconductor No. II-2 in Example II-2 was repeated except that the charge transport layer formation liquid employed in Example II-2 was replaced by the charge transport layer formation liquid prepared in Example II-6, so that an electrophotographic photoconductor No. II-7 for use in the present invention was fabricated.

EXAMPLE II-8

The procedure for fabrication of the electrophotographic photoconductor No. II-3 in Example II-3 was repeated except that the charge transport layer formation liquid employed in Example II-3 was replaced by the charge transport layer formation liquid prepared in Example II-6, so that an electrophotographic photoconductor No. II-8 for use in the present invention was fabricated.

EXAMPLE II-9

The procedure for fabrication of the electrophotographic photoconductor No. II-4 in Example II-4 was repeated except that the charge transport layer formation liquid employed in Example II-4 was replaced by the charge transport layer formation liquid prepared in Example II-6, so that an electrophotographic photoconductor No. II-9 for use in the present invention was fabricated.

EXAMPLE II-10

The procedure for fabrication of the electrophotographic photoconductor No. II-5 in Example II-5 was repeated except that the charge transport layer formation liquid employed in Example II-5 was replaced by the charge transport layer formation liquid prepared in Example II-6, so that an electrophotographic photoconductor No. II-10 for use in the present invention was fabricated.

EXAMPLE II-11

The procedure for fabrication of the electrophotographic photoconductor No. II-6 in Example II-6 was repeated except that toluene used as a solvent for preparing the charge transport layer formation liquid in Example II-6 was replaced by benzene, so that an electrophotographic photoconductor No. II-1 for use in the present invention was fabricated.

EXAMPLE II-12

The procedure for fabrication of the electrophotographic photoconductor No. II-2 in Example II-2 was repeated except that the charge transport layer formation liquid employed in Example II-2 was replaced by the charge transport layer formation liquid prepared in Example II-11, so that an electrophotographic photoconductor No. II-12 for use in the present invention was fabricated.

EXAMPLE II-13

The procedure for fabrication of the electrophotographic photoconductor No. II-3 in Example II-3 was repeated except that the charge transport layer formation liquid employed in Example II-3 was replaced by the charge transport layer formation liquid prepared in Example II-11, so that an electrophotographic photoconductor No. II-13 for use in the present invention was fabricated.

EXAMPLE II-14

The procedure for fabrication of the electrophotographic photoconductor No. II-4 in Example II-4 was repeated except that the charge transport layer formation liquid employed in Example II-4 was replaced by the charge transport layer formation liquid prepared in Example II-11, so that an electrophotographic photoconductor No. II-14 for use in the present invention was fabricated.

EXAMPLE II-15

The procedure for fabrication of the electrophotographic photoconductor No. II-5 in Example II-5 was repeated except that the charge transport layer formation liquid employed in Example II-5 was replaced by the charge transport layer formation liquid prepared in Example II-11, so that an electrophotographic photoconductor No. II-15 for use in the present invention was fabricated.

EXAMPLE II-16

The procedure for fabrication of the electrophotographic photoconductor No. II-6 in Example II-6 was repeated except that toluene used as a solvent for preparing the charge transport layer formation liquid in Example II-6 was replaced by m-xylene, so that an electrophotographic photoconductor No. II-16 for use in the present invention was fabricated.

EXAMPLE II-17

The procedure for fabrication of the electrophotographic photoconductor No. II-2 in Example II-2 was repeated except that the charge transport layer formation liquid in Example II-2 was replaced by the charge transport layer formation liquid prepared in Example II-16, so that an electrophotographic photoconductor No. II-17 for use in the present invention was fabricated.

EXAMPLE II-18

The procedure for fabrication of the electrophotographic photoconductor No. II-3 in Example II-3 was repeated except that the charge transport layer formation liquid in Example II-3 was replaced by the charge transport layer formation liquid prepared in Example II-16, so that an electrophotographic photoconductor No. II-18 for use in the present invention was fabricated.

EXAMPLE II-19

The procedure for fabrication of the electrophotographic photoconductor No. II-4 in Example II-4 was repeated except that the charge transport layer formation liquid in Example II-4 was replaced by the charge transport layer formation liquid prepared in Example II-16, so that an electrophotographic photoconductor No. II-19 for use in the present invention was fabricated.

EXAMPLE II-20

The procedure for fabrication of the electrophotographic photoconductor No. II-5 in Example II-5 was repeated except that the charge transport layer formation liquid in Example II-5 was replaced by the charge transport layer formation liquid prepared in Example II-16, so that an electrophotographic photoconductor No. II-20 for use in the present invention was fabricated.

EXAMPLE II-21

Formation of Undercoat Layer

The undercoat layer was provided on the aluminum drum in the same manner as in Example II-1.

Formation of Charge Generation Layer 20 parts by weight of an A-type titanyl phthalocyanine pigment and 400 parts by weight of methyl ethyl ketone were mixed and ground in a pot for 10 hours together with zirconium oxide balls.

To this mixture, a resin solution prepared by dissolving 10 parts by weight of the commercially available polyvinyl butyral resin (Trademark "XYHL", made by Union Carbide Japan K.K.) in 500 parts by weight of methyl ethyl ketone was added. The resultant mixture was ground in a ball mill for 2 hours, whereby a charge generation layer formation liquid was obtained.

The thus obtained formation liquid was coated on the above prepared undercoat layer, and dried at 70° C. for 10 minutes, so that a charge generation layer with a thickness of 0.3 $\mu$m was provided on the undercoat layer.

Formation of Charge Transport Layer

The charge transport layer was provided on the above prepared charge generation layer in the same manner as in Example II-1.

Thus, an electrophotographic photoconductor No. II-21 for use in the present invention was fabricated.

EXAMPLES II-22 to II-40

The procedure for fabrication of each of the electrophotographic photoconductors Nos. II-2 to II-20 respectively fabricated in Examples II-2 to II-20 was repeated except that the charge generation layer formation liquid employed in each Example was replaced by the charge generation layer formation liquid prepared in Example II-21, so that electrophotographic photoconductors No. II-22 to No. II-40 for use in the present invention were fabricated.

Measurement of Content of Solvent in CTL

The content of the remaining solvent in the charge transport layer was measured in the same manner as described in Example I-1.

Image Formation Test

Each of the electrophotographic photoconductors Nos. II-1 to II-40 respectively fabricated in Examples II-1 to II-40 was placed in a commercially available copying machine (Trademark "IMAGIO MF530", made by Ricoh Company, Ltd.).

Under the circumstances of 30° C. and 80% RH, 100,000 copies were continuously made on recording sheets using a chart including a solid image with an area ratio of 5%. The surface potentials of a background (non-image) area (Vw) and an image area (VL) were measured at the initial stage of the continuous copying operation and after making of 100,000 copies.

Further, the image quality was evaluated. To be more specific, when one or more black spots (toner deposition) with a diameter of 0.1 mm or more were observed within an area of 1 $cm^2$ of the background of a recording sheet, the number of recording sheets which had been already subjected to continuous copying operation was counted. The occurrence of toner deposition on the background of the recording sheet was expressed by the number of recording sheets thus counted.

In addition, occurrence of abnormal image caused by the crack on the photoconductor was visually inspected.

The results are shown in TABLE 6 and TABLE 7.

TABLE 6

| | | | | | | | Image Formation Test | | | | | |
|---|---|---|---|---|---|---|---|---|---|---|---|---|
| | | | | | | | Initial Stage | | After making of 100,000 copies | | Occurrence | |
| | | | Drying Conditons | Content of Residual Solvent (ppm) | | Change Ratio of | Potential | Potential | Potential | Potential | of Toner | Occur- |
| Example No. | CGM | Solvent of CTL Coating Liquid | of CTL Coating Liquid (° C.) × (min) | Immediately after drying | 24 hours after drying | Residual Solvent Content (%) | of image area (−V) | of background (−V) | of image area (−V) | of background (−V) | Deposition (No. of sheets) | rence of Abnormal Image |
| II-1 | (1)/(2) = | Dichloro- | 75 × 50 | 25200 | 23400 | 7.14 | 170 | 870 | 230 | 920 | 79,000 | None |
| II-2 | 19/1 | methane/ | 90 × 30 | 17200 | 15800 | 8.14 | 160 | 880 | 200 | 870 | 68,000 | None |
| II-3 | | ethyl- | 110 × 30 | 6350 | 5900 | 7.09 | 125 | 890 | 140 | 885 | 47,000 | None |

TABLE 6-continued

| Example No. | CGM | Solvent of CTL Coating Liquid | Drying Conditons of CTL Coating Liquid (° C.) × (min) | Content of Residual Solvent (ppm) Immediately after drying | Content of Residual Solvent (ppm) 24 hours after drying | Change Ratio of Residual Solvent Content (%) | Image Formation Test: Initial Stage Potential of image area (−V) | Image Formation Test: Initial Stage Potential of background (−V) | Image Formation Test: After making of 100,000 copies Potential of image area (−V) | Image Formation Test: After making of 100,000 copies Potential of background (−V) | Image Formation Test: Occurrence of Toner Deposition (No. of sheets) | Image Formation Test: Occurrence of Abnormal Image |
|---|---|---|---|---|---|---|---|---|---|---|---|---|
| II-4 | | benzene | 130 × 30 | 570 | 530 | 7.02 | 100 | 850 | 120 | 860 | 46,000 | None |
| II-5 | | | 160 × 30 | 120 | 120 | 0.00 | 180 | 860 | 130 | 750 | 33,000 | None |
| II-6 | | Toluene | 75 × 50 | 26500 | 25700 | 3.02 | 170 | 860 | 215 | 870 | 91,000 | None |
| II-7 | | | 90 × 30 | 17900 | 17600 | 1.68 | 120 | 875 | 150 | 870 | 88,000 | None |
| II-8 | | | 110 × 30 | 7600 | 7530 | 0.92 | 105 | 870 | 125 | 860 | 72,000 | None |
| II-9 | | | 130 × 30 | 570 | 560 | 1.75 | 95 | 860 | 105 | 855 | 71,000 | None |
| II-10 | | | 160 × 30 | 50 | 50 | 0.00 | 160 | 860 | 120 | 800 | 52,000 | None |
| II-11 | | Benzene | 75 × 50 | 27200 | 26600 | 2.21 | 190 | 880 | 230 | 890 | 89,000 | None |
| II-12 | | | 90 × 30 | 18000 | 17500 | 2.78 | 160 | 875 | 190 | 850 | 85,000 | None |
| II-13 | | | 110 × 30 | 9700 | 9300 | 4.12 | 100 | 860 | 120 | 870 | 76,000 | None |
| II-14 | | | 130 × 30 | 950 | 940 | 1.05 | 100 | 850 | 100 | 850 | 72,000 | None |
| II-15 | | | 160 × 30 | 15 | 15 | 0.00 | 175 | 855 | 110 | 840 | 59,000 | None |
| II-16 | | m-xylene | 75 × 50 | 30700 | 29500 | 3.91 | 160 | 860 | 190 | 865 | 85,000 | None |
| II-17 | | | 90 × 30 | 22100 | 21700 | 1.81 | 135 | 865 | 150 | 870 | 72,000 | None |
| II-18 | | | 110 × 30 | 15200 | 14900 | 1.97 | 110 | 855 | 120 | 850 | 68,000 | None |
| II-19 | | | 130 × 30 | 9800 | 9670 | 1.33 | 100 | 860 | 110 | 850 | 56,000 | None |
| II-20 | | | 160 × 30 | 1200 | 1170 | 2.50 | 150 | 850 | 100 | 860 | 49,000 | None |

TABLE 7

| Example No. | CGM | Solvent of CTL Coating Liquid | Drying Conditons of CTL Coating Liquid (° C.) × (min) | Content of Residual Solvent (ppm) Immediately after drying | Content of Residual Solvent (ppm) 24 hours after drying | Change Ratio of Residual Solvent Content (%) | Image Formation Test: Initial Stage Potential of image area (−V) | Image Formation Test: Initial Stage Potential of background (−V) | Image Formation Test: After making of 100,000 copies Potential of image area (−V) | Image Formation Test: After making of 100,000 copies Potential of background (−V) | Image Formation Test: Occurrence of Toner Deposition (No. of sheets) | Image Formation Test: Occurrence of Abnormal Image |
|---|---|---|---|---|---|---|---|---|---|---|---|---|
| II-21 | Titanyl | Dichloro- | 75 × 50 | 25200 | 23400 | 7.14 | 125 | 850 | 165 | 855 | 91,000 | None |
| II-22 | phthalo- | methane/ | 90 × 30 | 17200 | 15800 | 8.14 | 110 | 850 | 130 | 860 | 83,000 | None |
| II-23 | cyanine | ethyl- | 110 × 30 | 6350 | 5900 | 7.09 | 75 | 840 | 90 | 840 | 80,000 | None |
| II-24 | pigment | benzene | 130 × 30 | 570 | 530 | 7.02 | 60 | 840 | 80 | 830 | 80,000 | None |
| II-25 | | | 160 × 30 | 120 | 120 | 0.00 | 120 | 860 | 90 | 840 | 64,000 | None |
| II-26 | | Toluene | 75 × 50 | 26500 | 25700 | 3.02 | 140 | 855 | 170 | 855 | 100,000 | None |
| II-27 | | | 90 × 30 | 17900 | 17600 | 1.68 | 90 | 850 | 110 | 845 | 100,000 | None |
| II-28 | | | 110 × 30 | 7600 | 7530 | 0.92 | 80 | 860 | 90 | 840 | 100,000 | None |
| II-29 | | | 130 × 30 | 570 | 560 | 1.75 | 85 | 855 | 95 | 860 | 83,000 | None |
| II-30 | | | 160 × 30 | 50 | 50 | 0.00 | 110 | 860 | 80 | 855 | 69,000 | None |
| II-31 | | Benzene | 75 × 50 | 27200 | 26600 | 2.21 | 180 | 665 | 200 | 875 | 100,000 | None |
| II-32 | | | 90 × 30 | 18000 | 17500 | 2.78 | 130 | 855 | 150 | 860 | 100,000 | None |
| II-33 | | | 110 × 30 | 9700 | 9300 | 4.12 | 110 | 840 | 120 | 850 | 98,000 | None |
| II-34 | | | 130 × 30 | 950 | 940 | 1.05 | 95 | 840 | 110 | 830 | 88,000 | None |
| II-35 | | | 160 × 30 | 15 | 15 | 0.00 | 110 | 860 | 90 | 800 | 65,000 | None |
| II-36 | | m-xylene | 75 × 50 | 30700 | 29500 | 3.91 | 150 | 860 | 185 | 855 | 100,000 | None |
| II-37 | | | 90 × 30 | 22100 | 21700 | 1.81 | 130 | 860 | 155 | 855 | 95,000 | None |
| II-38 | | | 110 × 30 | 15200 | 14900 | 1.97 | 105 | 850 | 120 | 835 | 93,000 | None |
| II-39 | | | 130 × 30 | 9800 | 9670 | 1.33 | 95 | 860 | 95 | 850 | 89,000 | None |
| II-40 | | | 160 × 30 | 1200 | 1170 | 2.50 | 125 | 865 | 100 | 800 | 79,000 | None |

EXAMPLE II-41

The procedure for fabrication of the electrophotographic photoconductor No. II-3 in Example II-3 was repeated except that the aluminum drum with a diameter of 80 mm and a length of 359 mm, serving as the electroconductive support, used in Example II-3 was replaced by an aluminum drum with a diameter of 30 mm and a length of 340 mm.

Thus, an electrophotographic photoconductor No. II-41 for use in the present invention was fabricated.

EXAMPLES II-42 TO II-46

The procedure for fabrication of each of the electrophotographic photoconductors Nos. II-6 to II-10 respectively fabricated in Examples II-6 to II-10 was repeated except that the aluminum drum with a diameter of 80 mm and a length of 359 mm, serving as the electroconductive support, used in each Example was replaced by an aluminum drum with a diameter of 30 mm and a length of 340 mm.

Thus, electrophotographic photoconductors Nos. II-42 to II-46 for use in the present invention were fabricated.

EXAMPLE II-47

The procedure for fabrication of the electrophotographic photoconductor No. II-13 in Example II-13 was repeated except that the aluminum drum with a diameter of 80 mm and a length of 359 mm, serving as the electroconductive support, used in Example II-13 was replaced by an aluminum drum with a diameter of 30 mm and a length of 340 mm.

Thus, an electrophotographic photoconductor No. II-47 for use in the present invention was fabricated.

EXAMPLE II-48

The procedure for fabrication of the electrophotographic photoconductor No-II-18 in Example II-18 was repeated except that the aluminum drum with a diameter of 80 mm and a length of 359 mm, serving as the electroconductive support, used in Example II-18 was replaced by an aluminum drum with a diameter of 30 mm and a length of 340 mm.

Thus, an electrophotographic photoconductor No. II-48 for use in the present invention was fabricated.

EXAMPLE II-49

The procedure for fabrication of the electrophotographic photoconductor No. II-23 in Example II-23 was repeated except that the aluminum drum with a diameter of 80 mm and a length of 359 mm, serving as the electroconductive support, used in Example II-23 was replaced by an aluminum drum with a diameter of 30 mm and a length of 340 mm.

Thus, an electrophotographic photoconductor No. II-49 for use in the present invention was fabricated.

EXAMPLES II-50 TO II-54

The procedure for fabrication of each of the electrophotographic photoconductors Nos. II-26 to II-30 respectively fabricated in Examples II-26 to II-30 was repeated except that the aluminum drum with a diameter of 80 mm and a length of 359 mm, serving as the electroconductive support, used in each Example was replaced by an aluminum drum with a diameter of 30 mm and a length of 340 mm.

Thus, electrophotographic photoconductors Nos. II-50 to II-54 for use in the present invention were fabricated.

EXAMPLE II-55

The procedure for fabrication of the electrophotographic photoconductor No. II-33 in Example II-33 was repeated except that the aluminum drum with a diameter of 80 mm and a length of 359 mm, serving as the electroconductive support, used in Example II-33 was replaced by an aluminum drum with a diameter of 30 mm and a length of 340 mm.

Thus, an electrophotographic photoconductor No. II-55 for use in the present invention was fabricated.

EXAMPLE II-56

The procedure for fabrication of the electrophotographic photoconductor No. II-38 in Example II-38 was repeated except that the aluminum drum with a diameter of 80 mm and a length of 359 mm, serving as the electroconductive support, used in Example II-38 was replaced by an aluminum drum with a diameter of 30 mm and a length of 340 mm.

Thus, an electrophotographic photoconductor No. II-56 for use in the present invention was fabricated.

Measurement of Content of Solvent in CTL

The content of the remaining solvent in the charge transport layer was measured in the same manner as described in Example I-1.

Image Formation Test

Each of the electrophotographic photoconductors Nos. II-41 to II-56 respectively fabricated in Examples II-41 to II-56 was placed in a commercially available copying machine (Trademark "IMAGIO MF200", made by Ricoh Company, Ltd.) equipped with a charging roller capable of charging the photoconductor.

Under the circumstances of 30° C. and 80% RH, 50,000 copies were continuously made on recording sheets using a chart including a solid image with an area ratio of 5%. The surface potentials of a background (non-image) area (Vw) and an image area (VL) were measured at the initial stage of the continuous copying operation and after making of 50,000 copies.

Further, the image quality was evaluated. To be more specific, when one or more black spots (toner deposition) with a diameter of 0.1 mm or more were observed within an area of 1 $cm^2$ of the background of a recording sheet, the number of recording sheets which had been already subjected to continuous copying operation was counted. The occurrence of toner deposition on the background of the recording sheet was expressed by the number of recording sheets thus counted.

In addition, occurrence of abnormal image caused by the crack on the photoconductor was visually inspected.

The results are shown in TABLE 8.

TABLE 8

| Example No. | CGM | Solvent of CTL Coating Liquid | Drying Conditons of CTL Coating Liquid (° C.) × (min) | Content of Residual Solvent (ppm) Immediately after drying | Content of Residual Solvent (ppm) 24 hours after drying | Change Ratio of Residual Solvent Content (%) | Image Formation Test: Initial Stage Potential of image area (−V) | Image Formation Test: Initial Stage Potential of background (−V) | Image Formation Test: After making of 50,000 copies Potential of image area (−V) | Image Formation Test: After making of 50,000 copies Potential of background (−V) | Image Formation Test: Occurrence of Toner Deposition (No. of sheets) | Image Formation Test: Occurrence of Abnormal Image |
|---|---|---|---|---|---|---|---|---|---|---|---|---|
| II-41 | (1)/(2) = 19/1 | Dichloromethane/ethylbenzene | 110 × 30 | 6350 | 5900 | 7.09 | 160 | 905 | 155 | 915 | 32,000 | None |
| II-42 | | Toluene | 75 × 50 | 26500 | 25700 | 3.02 | 200 | 910 | 220 | 930 | 50,000 | Note 2 |
| II-43 | | | 90 × 30 | 17900 | 17600 | 1.68 | 170 | 890 | 180 | 910 | 43,000 | None |
| II-44 | | | 110 × 30 | 7600 | 7530 | 0.92 | 130 | 900 | 130 | 905 | 41,000 | None |
| II-45 | | | 130 × 30 | 570 | 560 | 1.75 | 130 | 890 | 110 | 900 | 42,000 | None |
| II-46 | | | 160 × 30 | 50 | 50 | 0.00 | 140 | 870 | 110 | 830 | 22,000 | None |
| II-47 | | Benzene | 110 × 30 | 9700 | 9300 | 4.12 | 140 | 890 | 165 | 905 | 43,000 | None |
| II-48 | | m-xylene | 110 × 30 | 15200 | 14900 | 1.97 | 135 | 900 | 145 | 910 | 40,000 | None |
| II-49 | Titanyl phthalocyanine pigment | Dichloromethane/ethylbenzene | 110 × 30 | 6350 | 5900 | 7.09 | 130 | 910 | 140 | 920 | 42,000 | None |
| II-50 | | Toluene | 75 × 50 | 26500 | 25700 | 3.02 | 175 | 905 | 185 | 910 | 50,000 | None |
| II-51 | | | 90 × 30 | 17900 | 17600 | 1.68 | 150 | 920 | 170 | 930 | 50,000 | None |
| II-52 | | | 110 × 30 | 7600 | 7530 | 0.92 | 135 | 900 | 140 | 900 | 50,000 | None |
| II-53 | | | 130 × 30 | 570 | 560 | 1.75 | 110 | 900 | 130 | 910 | 48,000 | None |
| II-54 | | | 160 × 30 | 50 | 50 | 0.00 | 150 | 890 | 100 | 850 | 39,000 | None |
| II-55 | | Benzene | 110 × 30 | 9700 | 9300 | 4.12 | 140 | 900 | 145 | 910 | 50,000 | None |
| II-56 | | m-xylene | 110 × 30 | 15200 | 14900 | 1.97 | 150 | 910 | 145 | 925 | 48,000 | None |

Note 2: The image density of a solid image was slightly decreased.

In Examples II-1 to II-56, as can be seen from the results shown in TABLE 6 to TABLE 8, the change in content of the solvent remaining in the charge transport layer is 10% or less 24 hours after the drying operation. In this case, the surface potentials of an image area and a background area are stable and the occurrence of toner deposition on the background can be efficiently prevented during the continuous image forming operation.

In particular, the above-mentioned advantages of the present invention are remarkably striking (i) when the solvent for use in the charge transport layer formation liquid comprises an aromatic hydrocarbon compound such as toluene, benzene or m-xylene, (ii) when the content of the remaining aromatic hydrocarbon compound employed as the solvent is in the range of 500 to 20,000 ppm with respect to the total weight of the charge transport layer immediately after the drying operation, (iii) the charge transport layer is dried at 80 to 150° C., (iv) the undercoat layer comprises titanium oxide and a binder resin, and (v) the charge generation layer comprises a metal-free phthalocyanine compound or metallo-phthalocyanine compound.

Furthermore, the same effects can be obtained when the photoconductor is charged using a charger which is disposed in contact with the photoconductor.

Japanese Patent Application No. 10-120072 filed Apr. 14, 1998 and Japanese Patent Application 11-105811 filed Apr. 13, 1999 are hereby incorporated by reference.

What is claimed is:

1. An image forming apparatus comprising a charging unit, an image exposure unit, a reversal development unit, an image transfer unit, and an electrophotographic photoconductor comprising an electroconductive support and a photoconductive layer formed thereon, said photoconductive layer being provided by coating and drying a photoconductive layer formation liquid comprising a solvent, with a change in the content of said solvent in said photoconductive layer dried being 10% or less 24 hours after the drying thereof.

2. The image forming apparatus as claimed in claim 1, wherein said electrophotographic photoconductor further comprises an undercoat layer which is interposed between said electroconductive support and said photoconductive layer.

3. The image forming apparatus as claimed in claim 1, wherein said solvent for use in said photoconductive layer formation liquid is selected from the group consisting of a cyclic ether compound, an aromatic hydrocarbon compound, and derivatives thereof.

4. The image forming apparatus as claimed in claim 1, wherein the content of said solvent remaining in said photoconductive layer is in a range of 500 to 20,000 ppm with respect to the total weight of said photoconductive layer immediately after the drying thereof.

5. The image forming apparatus as claimed in claim 1, wherein said photoconductive layer formation liquid is dried at temperature in a range of 80 to 150° C.

6. The image forming apparatus as claimed in claim 3, wherein said cyclic ether compound is selected from the group consisting of tetrahydrofuran, dioxane, and tetrahydropyran.

7. The image forming apparatus as claimed in claim 3, wherein said aromatic hydrocarbon compound is selected from the group consisting of toluene, benzene, and m-xylene.

8. The image forming apparatus as claimed in claim 2, wherein said undercoat layer of said photoconductor comprises titanium oxide and a binder agent.

9. The image forming apparatus as claimed in claim 1, wherein said photoconductive layer of said photoconductor comprises a phthalocyanine compound selected from the group consisting of a metallo-phthalocyanine compound and a metal-free phthalocyanine compound.

10. The image forming apparatus as claimed in claim 1, wherein said charging unit comprises a charger which is situated in contact with said photoconductor so as to charge said photoconductor.

11. The image forming apparatus as claimed in claim 1, wherein said charging unit comprises a charger which is situated out of contact with said photoconductor so as to charge said photoconductor.

* * * * *